US009557073B2

(12) United States Patent
Breed et al.

(10) Patent No.: US 9,557,073 B2
(45) Date of Patent: Jan. 31, 2017

(54) AIR DUCT SEALING SYSTEM FOR OBSTRUCTING OR DIRECTING AIRFLOW THROUGH PORTIONS OF AN AIR DUCT SYSTEM

(71) Applicants: Richard Corey Breed, Austin, TX (US); Kurt Herloff Petersen, Austin, TX (US)

(72) Inventors: Richard Corey Breed, Austin, TX (US); Kurt Herloff Petersen, Austin, TX (US)

( * ) Notice: Subject to any disclaimer, the term of this patent is extended or adjusted under 35 U.S.C. 154(b) by 392 days.

(21) Appl. No.: 14/187,267

(22) Filed: Feb. 22, 2014

(65) Prior Publication Data

US 2014/0315481 A1 Oct. 23, 2014

Related U.S. Application Data

(63) Continuation-in-part of application No. 13/754,865, filed on Jan. 30, 2013, now Pat. No. 9,360,230, and a continuation-in-part of application No. 13/108,957, filed on May 16, 2011, now abandoned, said application No. 13/754,865 is a continuation-in-part of application No. 12/757,397, filed on Apr. 9, 2010, now abandoned, and a continuation-in-part of application No. 13/108,957, filed on May 16, 2011, now abandoned, which is a continuation-in-part of application No. 12/757,397.

(Continued)

(51) Int. Cl.

| | |
|---|---|
| ***B25B 27/14*** | (2006.01) |
| ***F24F 13/20*** | (2006.01) |
| ***F24F 13/072*** | (2006.01) |
| ***F24F 13/08*** | (2006.01) |

(52) U.S. Cl.

CPC ..... *F24F 13/20* (2013.01); *F24F 13/072* (2013.01); *F24F 13/082* (2013.01); *Y10T 29/53909* (2015.01)

(58) Field of Classification Search

USPC ..... 29/278

See application file for complete search history.

(56) References Cited

U.S. PATENT DOCUMENTS 639,476 A * 12/1899 Whisler ..... B25B 27/24 152/429

2,834,278 A 5/1958 Crute, Jr.

(Continued)

OTHER PUBLICATIONS

Office Action dated Oct. 2, 2012 in U.S. Appl. No. 12/757,397.

Office Action dated Sep. 24, 2013 in U.S. Appl. No. 13/108,957.

*Primary Examiner* — Alvin Grant

(57) ABSTRACT

The present invention discloses adjustable air duct sealing systems for obstructing airflow through portions of an air duct system. Such systems may include an adjustable frame assembly configured to allow changes to a perimeter of the adjustable frame assembly. Systems may also include an actuator pole connector configured to attach the adjustable air duct sealing system to an actuator pole. Systems may include two or more support arms such that each support arm connects the actuator pole connector to the adjustable frame assembly and each support arm moveably connects to the actuator pole connector to allow the support arms to adjust to changes in the perimeter of the adjustable frame assembly. Some systems also include a sheet cover configured across the adjustable frame assembly to obstruct airflow through at least a portion of the adjustable frame assembly.

15 Claims, 12 Drawing Sheets

Related U.S. Application Data

(60) Provisional application No. 61/447,014, filed on Feb. 26, 2011.

(56) References Cited

U.S. PATENT DOCUMENTS 3,130,659 A 4/1964 Compton et al.
4,182,227 A * 1/1980 Roy ..... F24F 13/062 454/302
4,502,368 A 3/1985 Hempel
4,520,715 A 6/1985 Coomes et al.
4,964,438 A 10/1990 Welty
5,147,243 A * 9/1992 Inglis ..... F24F 13/072 454/323
5,192,244 A 3/1993 Rose
5,213,543 A 5/1993 Clarino
5,292,282 A * 3/1994 Callas ..... F24F 13/08 454/292
5,421,355 A * 6/1995 Cantwell ..... E04H 15/425 135/115
5,425,674 A 6/1995 Stach
5,479,984 A 1/1996 Easterbrook et al.
5,706,798 A * 1/1998 Steinorth ..... F24J 2/02 126/680
D392,860 S * 3/1998 Brown ..... D8/62
6,145,527 A * 11/2000 Gillis ..... E04H 15/425 135/124
6,152,157 A * 11/2000 Jang ..... E04H 15/50 135/126
6,499,497 B1 * 12/2002 Swetish ..... E04H 15/16 135/115
6,598,614 B2 * 7/2003 Liu ..... E04H 15/50 135/131
6,640,395 B2 11/2003 Bush
6,698,440 B2 * 3/2004 Beyer ..... A45B 23/00 135/25.41
6,832,951 B2 12/2004 Orendorff
7,104,877 B1 * 9/2006 Terry ..... B24D 15/023 451/354
7,249,996 B1 * 7/2007 Volyar ..... B24B 7/184 451/354
7,575,010 B2 * 8/2009 Rottmann ..... E04H 15/18 135/120.4
7,766,024 B2 * 8/2010 Rottmann ..... E04H 15/18 135/122
8,602,044 B2 * 12/2013 Zemitis ..... E04H 15/44 135/124
8,628,379 B1 * 1/2014 Galindo ..... B24D 15/023 451/344
2002/0069599 A1 6/2002 Dhallan
2004/0023005 A1 2/2004 Perez
2008/0196755 A1 * 8/2008 Cheng ..... E04H 15/20 135/126
2009/0302544 A1 12/2009 Pugh, Jr.
2010/0233953 A1 9/2010 Mavroudis et al.

* cited by examiner

AIR DUCT SEALING SYSTEM FOR OBSTRUCTING OR DIRECTING AIRFLOW THROUGH PORTIONS OF AN AIR DUCT SYSTEM

This application claims the benefit of and is a continuation-in-part of Non-Provisional application Ser. No. 13/108,957 entitled "Air Duct Blocking Device For Obstructing Airflow Through Portions Of An Air Duct System" and filed on May 16, 2011, which is incorporated herein by reference in its entirety. Non-Provisional application Ser. No. 13/108,957 claims the benefit of and is a continuation-in-part of Non-Provisional application Ser. No. 12/757,397 entitled "Air Vent Cover For Use In Testing Air Leakage Of An Air Duct System" and filed on Apr. 9, 2010, which is incorporated herein by reference in its entirety. Non-Provisional application Ser. No. 13/108,957 also claims the benefit of Provisional Application No. 61/447,014 entitled "Installation And Removal Tool For Use With An Air Vent Cover For Sealing An Air Vent" and filed on Feb. 26, 2011, which is incorporated herein by reference in its entirety.

This application claims the benefit of and is a continuation-in-part of Non-Provisional application Ser. No. 13/754,865 entitled "Air Duct Sealing System For Obstructing or Directing Airflow Through Portions Of An Air Duct System" and filed on Jan. 30, 2013, which is incorporated herein by reference in its entirety. Non-Provisional application Ser. No. 13/754,865 claims the benefit of and is a continuation-in-part of Non-Provisional application Ser. No. 12/757,397 entitled "Air Vent Cover For Use In Testing Air Leakage Of An Air Duct System" and filed on Apr. 9, 2010, which is incorporated herein by reference in its entirety. Non-Provisional application Ser. No. 13/754,865 also claims the benefit of and is a continuation-in-part of Non-Provisional application Ser. No. 13/108,957 entitled "Air Duct Blocking Device For Obstructing Airflow Through Portions Of An Air Duct System" and filed on May 16, 2011, which is incorporated herein by reference in its entirety.

TECHNICAL FIELD

The present invention relates to the field of removable air duct sealing systems for obstructing or directing airflow through portions of an air duct system.

BACKGROUND ART

As the trend to conserve energy continues, more individuals are demanding and more governmental entities are mandating that houses and commercial facilities undergo periodic energy audits. An energy audit is a service where a building structure's energy efficiency is evaluated by a person using professional equipment as blower door and infra-red cameras), with the aim to suggest the best ways to improve energy efficiency in heating and cooling the structure.

An energy audit involves recording various characteristics of the building envelope including the walls, ceilings, floors, doors, windows, and skylights. For each of these components the area and resistance to heat flow (R-value) is measured or estimated. The leakage rate or infiltration of air through the building envelope is of concern and is strongly affected by window construction and quality of door seals such as weather stripping. The goal of an audit is to quantify the building's overall thermal performance. The audit may also assess the efficiency, physical condition, and programming of mechanical systems such as the heating, ventilation, air conditioning (HVAC) equipment, and thermostat.

Leaks in an air duct system often account for a large percentage of energy being wasted in a typical home. In a residence, the percentage of air that escapes out of an air duct system due to leaks, on average, is approximately twenty-five percent (25%). Given that in some areas of the country, sixty percent (60%) to seventy percent (70%) of the cost of a household's monthly utilities bill is due to the operation of the HVAC system, air leakage in an air duct system may represent a significant waste of both monetary and energy resources.

Measuring the leakage in an air duct system is generally the most time consuming portion of a home energy audit. In fact, as much as fifty percent (50%) of the time required to perform a home energy audit is consumed in testing air leakage of an air duct system. The majority of that time is spent sealing off the various air vents so that the air duct system can be pressurized or depressurized to measure the air leaks.

Current methods of sealing off the air vents involve the use of a special adhesive tape that adheres to the face of an air vent. There are, however, certain drawbacks to the use of this adhesive tape. Applying and removing the adhesive tape to all of the air vents takes a significant amount of time because the adhesive tape is cumbersome and awkward to use. Commonly, the tape sticks to itself and those pieces have to be thrown away unused. The tape is generally stored in bulky spools that are heavy and difficult to maneuver. When the tape is removed from the spools, it can generate an extremely loud noise that may wake up members of a home that are asleep during the day, such as, for example a baby or elderly person taking a nap, or be disruptive to ongoing business concerns.

Another drawback is that the tape does not provide the best seal possible for the air duct system. Even after the tape is applied to the air vent, air may still enter and leave the air duct system beneath the face of the air vent that touches the wall or ceilings surface because the tape only blocks the openings of the air vent on the face of the air vent. The tape does not block openings between the air vent and surface on which the air vent is installed. An additional drawback occurs when the tape is removed. Because the tape uses a strong adhesive, damage often occurs to the wall, ceiling, or air vent when the tape is removed.

Even more problematic is the current process of sealing the pressurizing fan system to the return air vent after all of the other air vents have been sealed. In many buildings, the return air vent is located on the ceiling. Sealing the pressurizing fan system to the HVAC system involves awkwardly climbing a ladder with a flexible duct and trying to tape the flexible duct overhead to the air return vent while balancing on the ladder. Often, the weight of the flexible duct pulls the tape away from the air return vent and the operator has to repeat this process several times before adequately sealing the flexible duct to the return vent.

SUMMARY OF INVENTION

The present invention discloses an adjustable air duct sealing system for obstructing airflow through portions of an air duct system. An adjustable air duct sealing system according to embodiments of the present invention may include an adjustable frame assembly configured to allow changes to a perimeter of the adjustable frame assembly. Such an adjustable air duct sealing system according to embodiments of the present invention may also include an actuator pole connector configured to attach the adjustable air duct sealing system to an actuator pole and two or more support arms. Each such support arm may connects the actuator pole connector to the adjustable frame assembly and moveably connects to the actuator pole connector to allow the support arms to adjust to changes in the perimeter of the adjustable frame assembly. Such an adjustable air duct sealing system according to embodiments of the present invention may also include a sheet cover configured across the adjustable frame assembly to obstruct airflow through at least a portion of the adjustable frame assembly.

In other embodiments, an adjustable air duct sealing system according to embodiments of the present invention may include an adjustable frame assembly having eight rails. Such an exemplary frame assembly may be substantially rectangular in shape and configured to allow changes to a perimeter of the adjustable frame assembly. Each side of the adjustable frame assembly may include two of the eight rails configured to interlock and capable of moving parallel relative to one another. The two rails forming each side of the frame assembly may be held in place at predetermined intervals using a lock detent. Each corner of the frame assembly may include four corners such that each corner is formed from two of the eight rails connected together by a corner hinge. An adjustable air duct sealing system according to embodiments of the present invention may also include an actuator pole connector configured to attach the adjustable air duct sealing system to an actuator pole and two support arms. Each support arm may connect the actuator pole connector to the adjustable frame assembly and may be connected to the actuator pole connector by an integrated support hinge to allow the support arms to adjust to changes in width of the adjustable frame assembly. An adjustable air duct sealing system according to embodiments of the present invention may also include a stabilizer assembly having a stabilizing collar and two tension arms. Each tension arm may be connected to the stabilizing collar and to one of the two supporting arms to allow the tension arm to adjust to changes in position of the supporting arm to which that tension arm connects. An adjustable air duct sealing system according to embodiments of the present invention may also include a sheet cover configured across the adjustable frame assembly. The sheet cover may include an air duct connector capable of directing airflow through the adjustable frame assembly at the air duct connector while obstructing airflow through other portions of the adjustable frame assembly.

The present invention also discloses a remote actuator tool for installing and removing an air vent cover in an air duct sealing system. A remote actuator tool according to embodiments of the present invention may include a hollowed casing. The hollowed casing may include an opening on one side of the casing and may have a casing interior configured to mate with an adjustable fastener of the air vent cover when an actuator button of the adjustable fastener is depressed. The hollowed casing may include a slot that extends along an adjacent side from the opening to an opposite end of the casing relative to the opening. A remote actuator tool according to embodiments of the present invention may also include a pivot claw that connects to the casing at the opposite end of the casing relative to the opening and curls toward the opening. A remote actuator tool according to embodiments of the present invention may also include an extension pole interface configured on the opposite end of the casing relative to the opening. The extension pole interface may be configured to connect the remote actuator tool to an extension pole.

BRIEF DESCRIPTION OF DRAWINGS

The accompanying drawings, which are incorporated in and constitute a part of this specification, illustrate an implementation of apparatus and methods consistent with the present invention and, together with the detailed description, serve to explain advantages and principles consistent with the invention. In the drawings, FIG. 1 sets forth a drawing illustrating a perspective view of an exemplary adjustable air duct sealing system for obstructing airflow through portions of an air duct system according to embodiments of the present invention.

DESCRIPTION OF EMBODIMENTS

This application incorporates by reference in the entirety the specification, including the written description and drawings, of the following applications: Non-Provisional application Ser. No. 12/757,397 entitled "Air Vent Cover For Use In Testing Air Leakage Of An Air Duct System" and filed on Apr. 9, 2010; Provisional Application No. 61/447,014 entitled "Installation And Removal Tool For Use With An Air Vent Cover For Sealing An Air Vent" and filed on Feb. 26, 2011; Non-Provisional application Ser. No. 13/108,957 entitled "Air Duct Blocking Device For Obstructing Airflow Through Portions Of An Air Duct System" and filed on May 16, 2011; and Non-Provisional application Ser. No. 13/754,865 entitled "Air Duct Sealing System For Obstructing or Directing Airflow Through Portions Of An Air Duct System" and filed on Jan. 30, 2013, all of which are incorporated herein by reference in its entirety.

Figure 1:
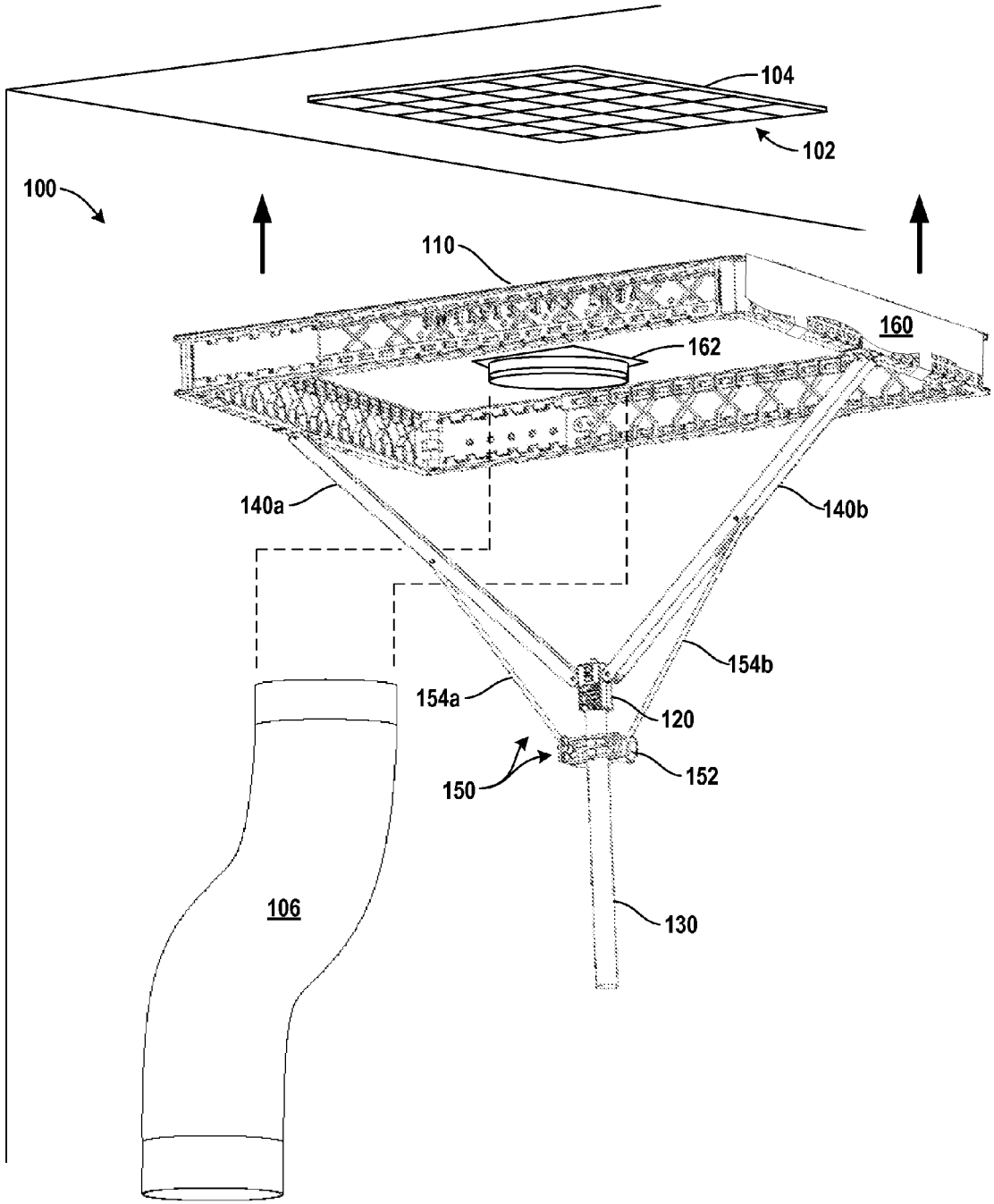

Exemplary embodiments of adjustable air duct sealing systems for obstructing airflow through portions of an air duct system are described herein with reference to the accompanying drawings, beginning with FIG. 1. FIG. 1 sets forth a drawing illustrating a perspective view of an exemplary adjustable air duct sealing system (100) for obstructing airflow through portions of an air duct system (102) according to embodiments of the present invention. Air duct systems are used in heating, ventilation, and air conditioning (HVAC) to deliver, circulate, or remove air using supply, return, or exhaust airflows. Air duct systems, therefore, are one method of ensuring acceptable indoor air quality as well as thermal comfort.

Though air duct systems vary from one installation to another, many air duct system share a common set of components. Air duct systems generally include an air handler unit that may be composed of a blower or fan, heating or cooling elements, filters, humidifier, mixing chamber, heat recovery device, controls, and vibration isolators. In addition, air duct systems typically include other components such as networks of plenums, ducts, and boots that direct airflow between the air handler unit and various air vents registers used to supply air to or return air from the spaces served by the air duct system. Readers will note that much of the air vent system is omitted from the Figures for clarity as these components are well known and understood by those of skill in the art.

To detect leaks in an air duct system, a technician will typically pressurize or depressurize the air duct system and measure the changes in air pressure throughout the system over time. Exemplary removable air duct sealing systems according to embodiments of the present invention are useful in obstructing airflow through portions of an air duct system. Exemplary removable air duct sealing systems according to embodiments of the present invention typically connect to an air duct system component such as, for example, an air vent register or grill or an air vent register boot. An air vent register is an opening, typically forming a grill, in an air duct system that serves to supply air to or return air from a space served by the air duct system. A register boot is a device that provides a physical interface between an air duct and an air vent register. Those of skill in the art often may collectively refer to an "air vent register" and "register boot" as an air diffuser, an air grate, or a terminal unit.

Exemplary removable air duct sealing systems according to embodiments of the present invention may be placed over the air vent register or register boot to create a seal for inhibiting air flow through the register or boot, and consequently a portion of the HVAC system, while testing air leakage of the air duct system. The air may attempt to flow through the air vent register or register boot due to either pressurization or depressurization of the air duct system during the leak testing process. Systems used to pressurize or depressurize an air duct system are known to those of skill in the art and may include, for example, the Minneapolis Duct Blaster® or the Retrotec Duct Testing Blower System.

The exemplary adjustable air duct sealing system (100) for obstructing airflow through portions of an air duct system (102) of FIG. 1 seals off the return air vent (104) and so that a pressurizing or depressurizing blower may be connected to the air duct system (102) through the flexible duct (106).

The exemplary adjustable air duct sealing system (100) of FIG. 1 includes an adjustable frame assembly (110) configured to allow changes to a perimeter of the adjustable frame assembly (110). Because the frame assembly (110) of FIG. 1 is substantially rectangular in shape, changes to the perimeter of the adjustable frame assembly (110) of FIG. 1 occur when an operator changes the length or width of the frame assembly (110). The adjustability of the frame assembly (110) of FIG. 1 allows the air duct sealing system (100) to adapt to air vents of different sizes. Those of skill in the art will recognize that the rectangular shape of the frame assembly (110) of FIG. 1 is for example only and not for limitation. In other embodiments, exemplary frame assembly may take on a variety of other shapes including for example a circular shape. Such circular embodiments may employ a circular lattice structure to permit the frame assembly to have an adjustable perimeter or implement a structure similar to the Ring Ruler by Koala Tools™.

In the example of FIG. 1, the adjustable frame assembly (110) is composed of eight frame rails. Each side of the frame assembly (110) of FIG. 1 is formed from two frame rails that interlock with one another and slide parallel to another. This ability to slide parallel to one another is what allows the frame assembly (110) of FIG. 1 to adjust the length and width of the structure so as to alter the perimeter and cover a variety of air vent sizes. After an operator has slid the rails in place, the operator may lock those rails in place relative to one another using a lock detent. The lock detent could be implemented as pin inserted into holes that align on the two frame rails sliding next to one another, or the lock detent could be a spring-loaded ball detent, or any number of other detents useful in this embodiment of the present invention. For the operator's convenience, the lock detent secures the rails in place relative to another at predetermined positions. In the example of FIG. 1, the predetermined positions are placed one inch apart along the length of the rails from the frame assembly (110).

Each corner of the adjustable frame assembly (110) of FIG. 1 is formed from two of the frame rails connected together with a hinge integrated into the ends of the two frame rails forming the corner. Each of the rails forming a corner of the frame assembly (110) of FIG. 1 also includes an overextension detent to prevent the two frame rails from opening more than ninety degrees. The overextension detents in the example of FIG. 1 are on the exterior of the corners of the adjustable frame assembly (110). The overextension detents of the system in FIG. 1 are formed to restrict the rotational movement of the frame rails around the hinges on the interior corners. Limiting the ability of the corners of the frame assembly (110) of FIG. 1 to ninety degrees or less provides the additional stability to the shape and structure of the frame assembly (110). For example, without limiting the corners of the frame assembly (110) of FIG. 1 to ninety degrees or less, the frame assembly (110) of FIG. 1 might undesirously shift in shape to a non-rectangular parallelogram and then collapse. This additional stability allows the adjustable air duct sealing system (100) of FIG. 1 to operate effectively with minimal additional structural supports when being operated remotely at the end of an actuator pole (130).

The adjustable air duct sealing system (100) of FIG. 1 includes an actuator pole connector (120) configured to attach the adjustable air duct sealing system (100) to the actuator pole (130). In the example of FIG. 1, the actuator pole connector (120) includes an interface that corresponds with the interface on the actuator pole (130) so that the actuator pole (130) may be inserted into or lock onto the actuator pole connector (120). Specifically in FIG. 1, the actuator pole (130) may be implemented as a telescoping extension pole such as for example an extension pole utilized by a painter. These extension poles had a threaded screw interface on the distal end so that these extension poles may be screwed into some other device or tool to be operated at a distance. In the example of FIG. 1, the actuator pole (130) includes this threaded structure at the distal end, and the actuator pole connector (120) of FIG. 1 includes a threaded cavity into which the actuator pole (130) is screwed into place. On the opposite end of the actuator pole connector (120) in the example of FIG. 1, the actuator pole connector (120) includes two integrated hinge structures that connect to support arms (140).

In the example of FIG. 1, the adjustable air duct sealing system (100) includes two support arms (140). Each support arm (140) of FIG. 1 is a brace that connects the frame assembly (110) with the actuator pole connector (120). Each support arm (140) in the example of FIG. 1 connects to the actuator pole connector (120) via an integrated hinge. The hinge connection between each support arm (140) and the actuator pole connector (120) in FIG. 1 allows the support arms (140) to rotate away from each other and span a larger distance that might be needed when the length of the frame assembly is increased for a larger air vent. Similarly, the hinge connection between each support arm (140) and the actuator pole connector (120) in FIG. 1 allows the support arms (140) to rotate toward each other and span shorter distance that might be needed when the length of the frame assembly is decreased for a smaller air vent. In this way, each support arm (140) of FIG. 1 is moveably connected to the actuator pole connector (120) to allow the support arms (140) to adjust to changes in the perimeter of the adjustable frame assembly (110).

Those of skill in the art will recognize that the use of a hinge is but one way of forming a moveable connection. Another example of a moveable connection might include the use of a rod or rail that connects to another component by passing through a guide attached to the other component. The rod or rail passes through the guide and is held in place by a fastener, which in turn could be a screw that provides force to the rod or rail to hold it in place. Of course, these examples described are for explanation only and not for limitation. Still other moveable connections may be utilized in embodiments of the present invention as will occur to those of skill in the art.

In the example of FIG. 1, the support arms (140) and the actuator pole connector (120) are separate components, but one of skill in the art will note that those components may be integrated into a single unit. That is, the actuator pole connector may be integrated into the support arms of some adjustable air duct sealing systems according to embodiments of the present invention.

The adjustable air duct sealing system (100) of FIG. 1 includes a stabilizer assembly (150). The stabilizer assembly (150) of FIG. 1 operates to minimize undesired movements of the adjustable air duct sealing system (100). That is, the stabilizer assembly (150) of FIG. 1 assists in keeping the positions of the various components of the exemplary adjustable air duct sealing system (100) of FIG. 1 constant relative to one another.

In FIG. 1, the stabilizer assembly (150) includes a stabilizing collar (152) and two tension arms (154). Each tension arm (154) in FIG. 1 is connected to one of the supporting arms (140) and to the stabilizing collar (152). Each tension arm (154) in FIG. 1 moveably connects to the stabilizing collar (152) to allow the tension arm (154) to adjust to changes in position of the supporting arm (140) to which that tension arm (154) connects. In this way, the connections to the supporting arms (140) and to the stabilizing collar (152) permit some range of movement for each tension arm (154) relative to the other components until the various components of the air duct sealing system (100) are locked and/or fastened into place. Once the various components of the air duct sealing system (100) are in place—that is, the rails on the frame assembly (110) are adjusted to the desired dimensions and the support arms (140) are connected to the frame assembly (110)—the movement of the tension arms (154) in FIG. 1 is restricted and in turn the tension arms operate to restrict the movement of other components of the system (100). In this way the stabilizer assembly (150) of FIG. 1 keeps the support arms from rotating relative to the actuator pole connector (120) and/or the actuator pole (130).

The stabilizing collar (152) of FIG. 1 forms a hollowed central region to allow the actuator pole (130) to pass through the stabilizing collar (152) when the actuator pole (130) is inserted into the actuator pole connector (120). In the example of FIG. 1, however, the stabilizing collar (152) is not fixed to the actuator pole (130) and therefore may move coaxially along the actuator pole (130) as the two or more tension arms (154) change position relative to the stabilizing collar (152). Of course, in the example of FIG. 1, the tension arms (154) change position when the support arms (140) change position, and the support arms change position when the frame assembly (110) adjusts to changes in the desired perimeter.

In the example of FIG. 1, the adjustable air duct sealing system (100) includes a sheet cover (160) configured across the adjustable frame assembly (110) to obstruct airflow through at least a portion of the adjustable frame assembly (110). The sheet cover (160) of FIG. 1 is a thin layer of material that drapes across the frame assembly (110) and fastens to the frame assembly (110) or some other component of the air duct sealing system (100) or, if it is long enough or have the requisite straps, folds back and connects to itself. The material from the sheet cover (160) of FIG. 1 is made is a form of parachute fabric, which is lightweight and resists airflow permeation. One skilled in the art, however, will recognize that this is for example only and not for limitation, nylon, rubber, plastic, synthetic fiber, natural fiber, or any other material as will occur to those of skill in the art may also be used to form the sheet cover (160) so long as the material substantially resists airflow permeation.

In the example of FIG. 1, when the adjustable air duct sealing system (100) of FIG. 1 is pressed toward the air vent (104), the air flow through the air vent (104) will be blocked by the sheet cover (160) inside the frame assembly (110) except that portion that passes through the air duct connector (162) integrated into the sheet cover (160). Once the operator has the adjustable air duct system (100) of FIG. 1 in place, the operator can adjust the telescoping actuator pole (130) so that the end not connected to the adjustable air duct sealing system is placed against the floor to hold the adjustable air duct sealing system (100) against the air vent (104). The air duct connector (162) of FIG. 1 is connected to the air duct (106), which typically is connected to a pressurization blower that will pressurize or depressurize the air duct system (102). Because a typically air duct system (102) will only require one pressurization blower connected to the system, an adjustable air duct sealing system according to embodiments of the present invention that does not include the air duct connector (162) in the sheet cover (160) could be used to completely block airflow through a particular air vent located on the ceiling that does not need to have the pressurization system attached. In this manner, one the adjustable air duct sealing systems according to embodiments of the present invention would include the air duct connector (162) to allow the pressurization system to connect to the air duct system, but the other adjustable air duct sealing systems according to embodiments of the present invention that are used with air vents on that same air duct system would not need the air duct connector configured in the sheet cover.

Regardless of whether the adjustable air duct sealing system includes an air duct connector and air duct, however, the operator of adjustable air duct sealing systems according to embodiments of the present invention may press sealing systems onto the air vent and then adjust the telescoping actuator pole so that it touches the ground and keeps upward pressure on the adjustable air duct sealing system toward the air vent. In this way, the operator need not continuously hold the adjustable air duct sealing system onto the air vent during the pressurization of an air duct system.

Figure 11:
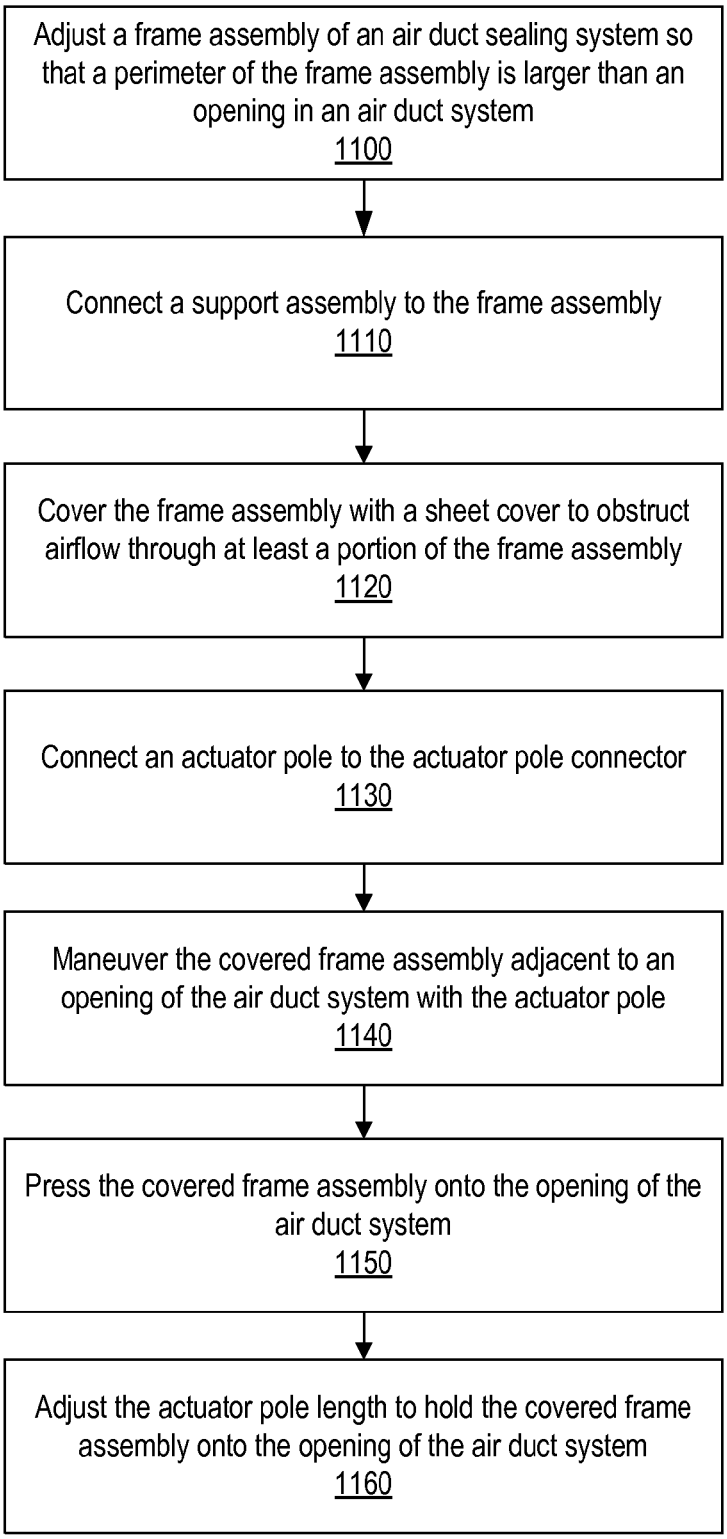
FIG. 11 sets forth a line drawing illustrating a flow chart of an exemplary method of obstructing airflow through portions of an air duct system according to embodiments of the present invention

Using the exemplary adjustable air duct sealing system (100) of FIG. 1, an operator may perform methods of obstructing airflow through portions of an air duct system. Turning to FIG. 11, FIG. 11 sets forth a line drawing illustrating a flow chart of an exemplary method of obstructing airflow through portions of an air duct system according to embodiments of the present invention.

An exemplary such method may include adjusting (1100) a frame assembly of an air duct sealing system so that a perimeter of the frame assembly is larger than an opening in an air duct system. The operator may need to adjust both the length and the width—or only the width or only the length—depending on the size of the air vent opening that is to be covered. To assist in ensuring that the opposite sides of the frame rail assembly are adjusted to the same size, the operator may lock the frame rails in place at a predetermined position using the lock detent. The frame rails may include markers or indications of position at each of the predetermined position so that an operator can easily select and engage the lock detent at the same predetermined position for both sides of the frame assembly. For example, the predetermined positions may be marked numerically with integers '1', '2', '3', and so on. The frame assembly may be configured such that the predetermined positions ascribed with the '2' is at the same position on all sides of the frame assembly.

The exemplary method of FIG. 11 continues with an operator connecting (1110) a support assembly to the frame assembly. An exemplary support assembly includes an actuator pole connector and two or more support arms, such as for example those described with reference to FIG. 1. The exemplary actuator pole connector described with reference to FIG. 11 is configured to attach the adjustable air duct sealing system to an actuator pole. Each support arm in the method of FIG. 11 connects the actuator pole connector to the adjustable frame assembly, and each support arm moveably connects to the actuator pole connector to allow the support arms to adjust to changes in the perimeter of the adjustable frame assembly. The support assembly described with reference to FIG. 11 may include a stabilizer assembly, which in turn may include a stabilizing collar and two or more tension arms. Each tension arm may connect to one of the two or more supporting arms and be moveably connected to the stabilizing collar to allow the tension arm to adjust to changes in position of the supporting arm to which that tension arm connects.

The exemplary method of FIG. 11 includes covering (1120) the frame assembly with a sheet cover to obstruct airflow through at least a portion of the frame assembly. An operator will cover (1120) the frame assembly according to the method of FIG. 11 by laying the sheet cover on the ground. If the sheet cover includes an air duct connector, the operator may take care to center the frame assembly over the air duct connector in the sheet cover. The operator may then wrap the sheet cover around the frame assembly and secure the sheet cover onto the frame assembly by fastening the sheet cover with snap fasteners to itself or the frame assembly. Of course, other types of fasteners may also be used in accordance with the method of FIG. 11.

The exemplary method of FIG. 11 further includes connecting (1130) an actuator pole to the actuator pole connector, maneuvering (1140) the covered frame assembly adjacent to an opening of the air duct system with the actuator pole, pressing (1150) the covered frame assembly onto the opening of the air duct system, and adjusting (1160) the actuator pole length to hold the covered frame assembly onto the opening of the air duct system.

Figure 2A:
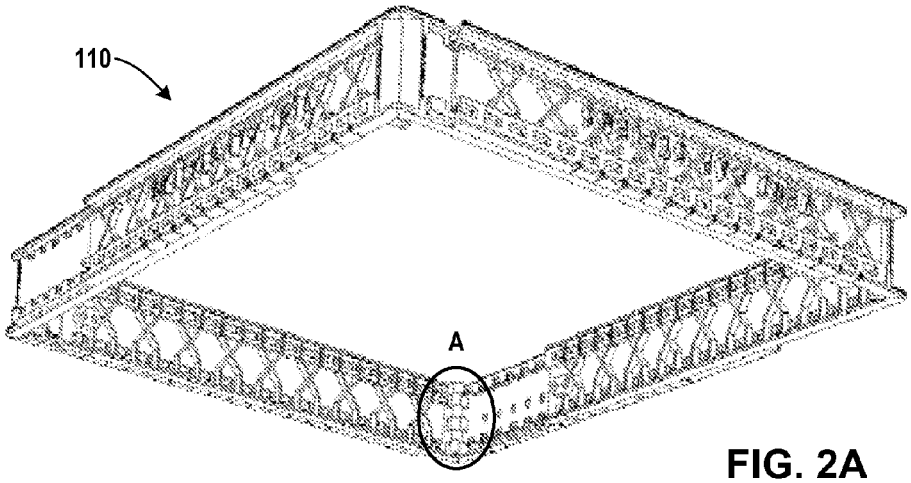
FIG. 2A sets forth a line drawing illustrating a perspective view of the exemplary adjustable frame assembly of FIG. 1 that is useful in an exemplary adjustable air duct sealing system for obstructing airflow through portions of an air duct system according to embodiments of the present invention.

FIGS. 2A-E further illustrate the exemplary adjustable frame assembly (110) of FIG. 1 that is useful in an exemplary adjustable air duct sealing system for obstructing airflow through portions of an air duct system according to embodiments of the present invention. FIG. 2A illustrates a perspective view of the exemplary adjustable frame assembly (110) of FIG. 1. The exemplary adjustable frame assembly (110) of FIG. 2A is formed from eight frame rails. Each side of the adjustable frame assembly (110) of FIG. 2A includes two of the frame rails configured to interlock with one another and slide parallel to one another. The interlocking nature of the frame rails shall be discussed in more detail with reference to FIGS. 2D and 2E.

Each corner of the adjustable frame assembly (110) of FIG. 2A is formed from two of the frame rails connected together with a hinge integrated into the frame rails. For further explanation, FIG. 2B sets forth a line drawing that illustrates a close up view of the integrated hinge at Section A of FIG. 2A. The corner of the exemplary frame assembly (110) in the illustration of FIG. 2B is formed from frame rail (1140 and frame rail (114*g*). Frame rail (114*g*) has hinge knuckles (202*a*) that correspond with the hinge knuckles (202*b*) of frame rail (1140. The hinge knuckles (202*a* and 202*b*) integrated into the frame rails (114*g* and 1140 are held together by a hinge pin (200). The hinge illustrated in FIG. 2B allows frame rails (114*f* and 114*g*) to be configured in a closed position such that the frame rails (114*f* and 114*g*) form angle between one another of substantially zero degrees or be configured in an open position such that the frame rails (114*f* and 114*g*) form angle between one another of substantially ninety degrees or be configured to form any angle there between. To prevent the overextension of the frame rails (114*f* and 114*g*) beyond ninety degrees, each frame rail (114*f* and 114*g*) includes an overextension detent (201) near the hinge to provide a physical barrier that prevents the frame rails (114*f* and 114*g*) from swinging around the hinge pin (200) and creating an angle greater than ninety degrees.

Figure 2C:
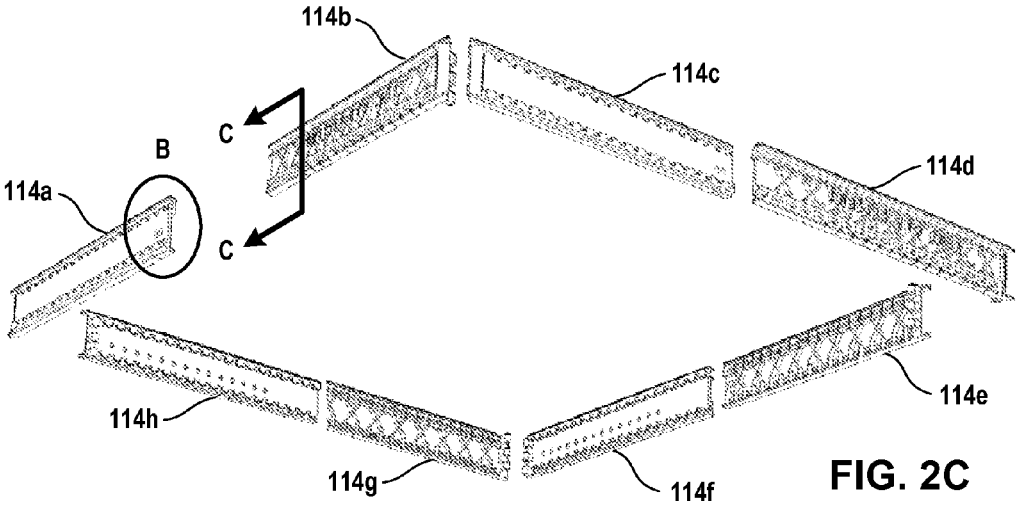
FIG. 2C sets forth a line drawing illustrating a perspective view of the exemplary adjustable frame assembly of FIG. 1 that is useful in an exemplary adjustable air duct sealing system for obstructing airflow through portions of an air duct system according to embodiments of the present invention.
Figure 2B:
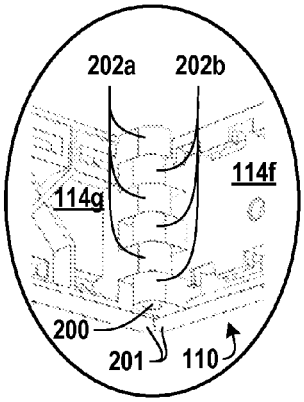
FIG. 2B sets forth a line drawing illustrating a perspective, exploded view of the exemplary adjustable frame assembly of FIG. 1 that is useful in an exemplary adjustable air duct sealing system for obstructing airflow through portions of an air duct system according to embodiments of the present invention.

FIG. 2C illustrates an exploded, perspective view of the exemplary adjustable frame assembly (110) of FIG. 1. The exemplary adjustable frame assembly (110) illustrated in FIG. 2C is formed from eight frame rails (114*a-h*). The example of FIG. 2C, frame rail (114*a*) and frame rail (114*b*) interlock and slide parallel with one another. Frame rail (114*c*) and frame rail (114*d*) of FIG. 2C interlock and slide parallel with one another. Similarly, frame rail (114*e*) and frame rail (114*f*) of FIG. 2C interlock and slide parallel with one another, and frame rail (114*g*) and frame rail (114*h*) of FIG. 2C interlock and slide parallel with one another.

Figure 2D:
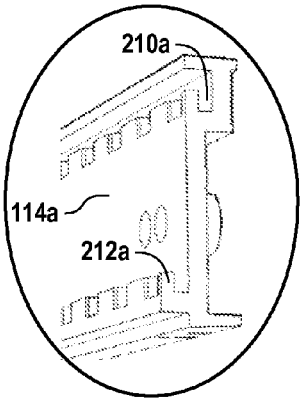
FIG. 2D sets forth a line drawing illustrating a perspective view of the exemplary adjustable frame assembly of FIG. 1 that is useful in an exemplary adjustable air duct sealing system for obstructing airflow through portions of an air duct system according to embodiments of the present invention.
Figure 2E:
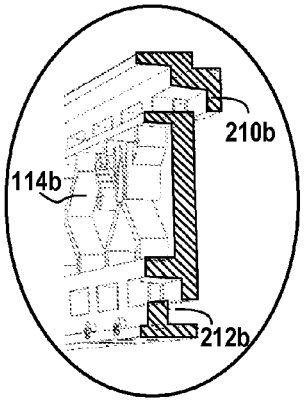
FIG. 2E sets forth a line drawing illustrating a perspective view of cross-section C-C of the exemplary adjustable frame assembly of FIG. 1 that is useful in an exemplary adjustable air duct sealing system for obstructing airflow through portions of an air duct system according to embodiments of the present invention.

The manner in which the exemplary frame rails (114) of FIG. 2C interlock and slide parallel with one another is described in more detail with reference to FIGS. 2D and 2E. FIG. 2D sets forth a line drawing that illustrates a close up view of the end of frame rail (114*a*) at Section B of FIG. 2C. FIG. 2E sets forth a line drawing that illustrates cross-sectional view C-C of frame rail (114*b*) in FIG. 2C. Frame rails (114*a* and 114*b*) interlock using a system of rail detents and rail slots. As illustrated in FIGS. 2D and 2E, the L-shaped rail slot (210*a*) on frame rail (114*a*) is configured to correspond to and receive the L-shaped rail detent (210*b*) of frame rail (114*b*). Similarly, as illustrated in FIGS. 2D and 2E, the L-shaped rail slot (212*b*) on frame rail (114*b*) is configured to correspond to and receive the L-shaped rail detent (212*a*) of frame rail (114*a*). In this manner, each exemplary frame rail has both a rail detent and rail slot to assist with interlocking the two frame rails. The rail slots (210*a*) and (212*b*) in FIGS. 2D and 2E form rail channels that extend along each of the frame rails (114*a* and 114*b*) and in this way allow the two frame rails (114*a* and 114*b*) to move parallel with one another while remaining interlocked.

The exemplary frame assembly of FIG. 1 and FIGS. 2A-E is implemented using eight frame rails. Those of ordinary skill the art will recognize, however, that such an embodiment is for explanation only and not for limitation. In other exemplary air duct sealing systems according to embodiments of the present invention, the frame assembly may be implemented with more or less number of frame rails. For example, in some embodiments, the frame assembly may be implemented with only four frame rails. Each such exemplary frame rails may have an L-shape so that the corners of such a frame assembly are integrated into each frame rail. The straight portions of the L-shaped frame rails may interlock with the straight portion of an adjacent L-shaped frame rails and such that the straight portions of the adjacent L-shaped frame rails slide parallel to one another. In other embodiments, an exemplary frame assembly may be implemented with three or more telescoping frame rails on each side of such an exemplary frame assembly. The distal telescoping end may connect at a right angle with an adjacent set of three or more telescoping frame rails to form a corner of such an exemplary frame assembly. An exemplary frame assembly useful in adjustable air duct sealing systems according to embodiments of the present invention may take many other forms and structures without limitation by the examples illustrated and described herein.

Figure 3A:
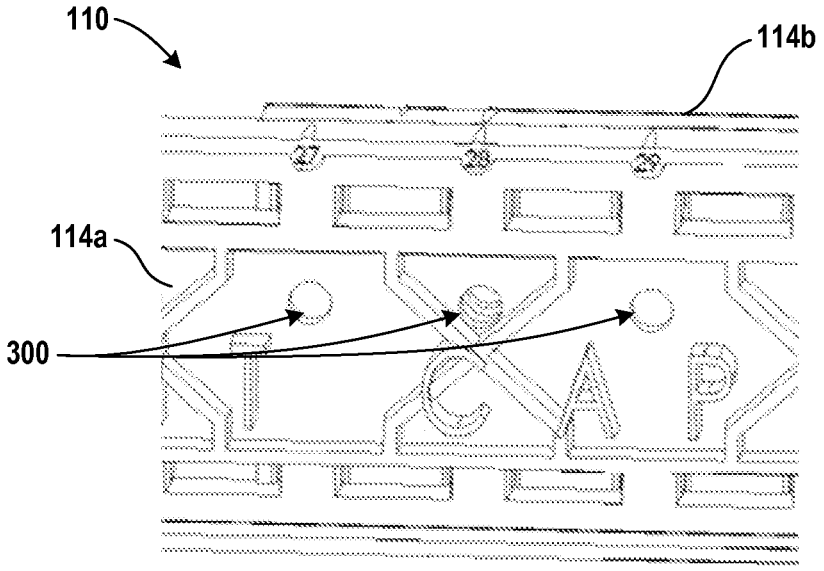
FIG. 3A sets forth a line drawing illustrating a perspective view of exemplary frame rails of an exemplary frame assembly that is useful in an exemplary adjustable air duct sealing system for obstructing airflow through portions of an air duct system according to embodiments of the present invention.
Figure 3B:
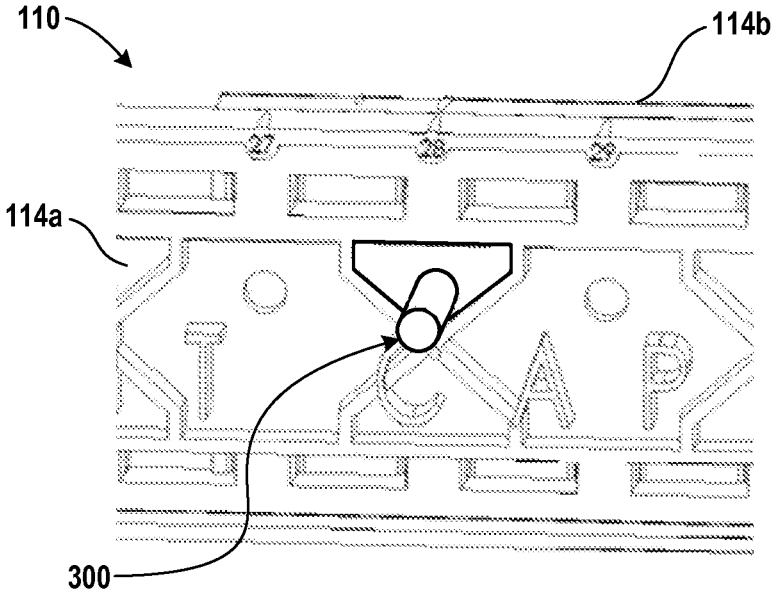
FIG. 3B sets forth a line drawing illustrating a perspective view of exemplary frame rails of an exemplary frame assembly that is useful in an exemplary adjustable air duct sealing system for obstructing airflow through portions of an air duct system according to embodiments of the present invention.

As previously mentioned, the frame rails in the exemplary frame assembly (110) of FIG. 1 lock into place at predetermined intervals. For further explanation, consider FIGS. 3A and 3B, each being line drawings that illustrate a portion of the exemplary frame assembly (110) of FIG. 1. The exemplary frames rails (114*a* and 114*b*) depicted in FIGS. 3A and 3B interlock with one another and slide in parallel relative to each other. The frames rails (114*a* and 114*b*) of FIGS. 3A and 3B may be secured in place relative to one another at predetermined positions (300). In the example of FIGS. 3A and 3B, the predetermined positions (300) are implemented using holes through which a lock detent (302) is capable of sliding through. For clarity, FIG. 3A omits the lock detent, and by such omission, reveals the two holes in the frame rails that are aligned at this predetermined position for locking the two frame rails (114*a* and 114*b*) in place. A predetermined position is so called because the position was configured by someone other than the operator such as, for example, the designer of the frame assembly. The number of predetermined positions in a particular embodiment may vary from a one embodiment to another.

The lock detent (302) of FIG. 3B is implemented as a pin that slides through the holes forming the predetermined positions at which the two frame rails may be secured relative to one another. In the example of FIG. 3B, the lock detent (302) is a structure that prevents the frame rails (114*a* and 114*b*) from moving relative to one another when the lock detent is engaged. Those of skill in the art will recognize that implementing the lock detent and predetermined positions as a pin and set of aligned holes as illustrated in FIGS. 3A and 3B and described herein with reference to these Figures is for explanation only and not for limitation. Other implementations of the lock detent and predetermined positions may also be useful in exemplary air duct sealing system according to the embodiments of the present invention. For example, the predetermined positions may be divots and the lock detent may be a spring loaded catch that corresponds to the divots. When such a catch is set into a divot, the frictional force created by that configuration may keep the two interlocked rails from sliding relative to one another so long as the catch is engaged with a divot. Still further, the lock detent and predetermined positions may also be implemented using a ratchet system. Still further, other exemplary detent locks may be implemented using a spring-loaded ball that fills the holes rather an a pin.

Figure 4:
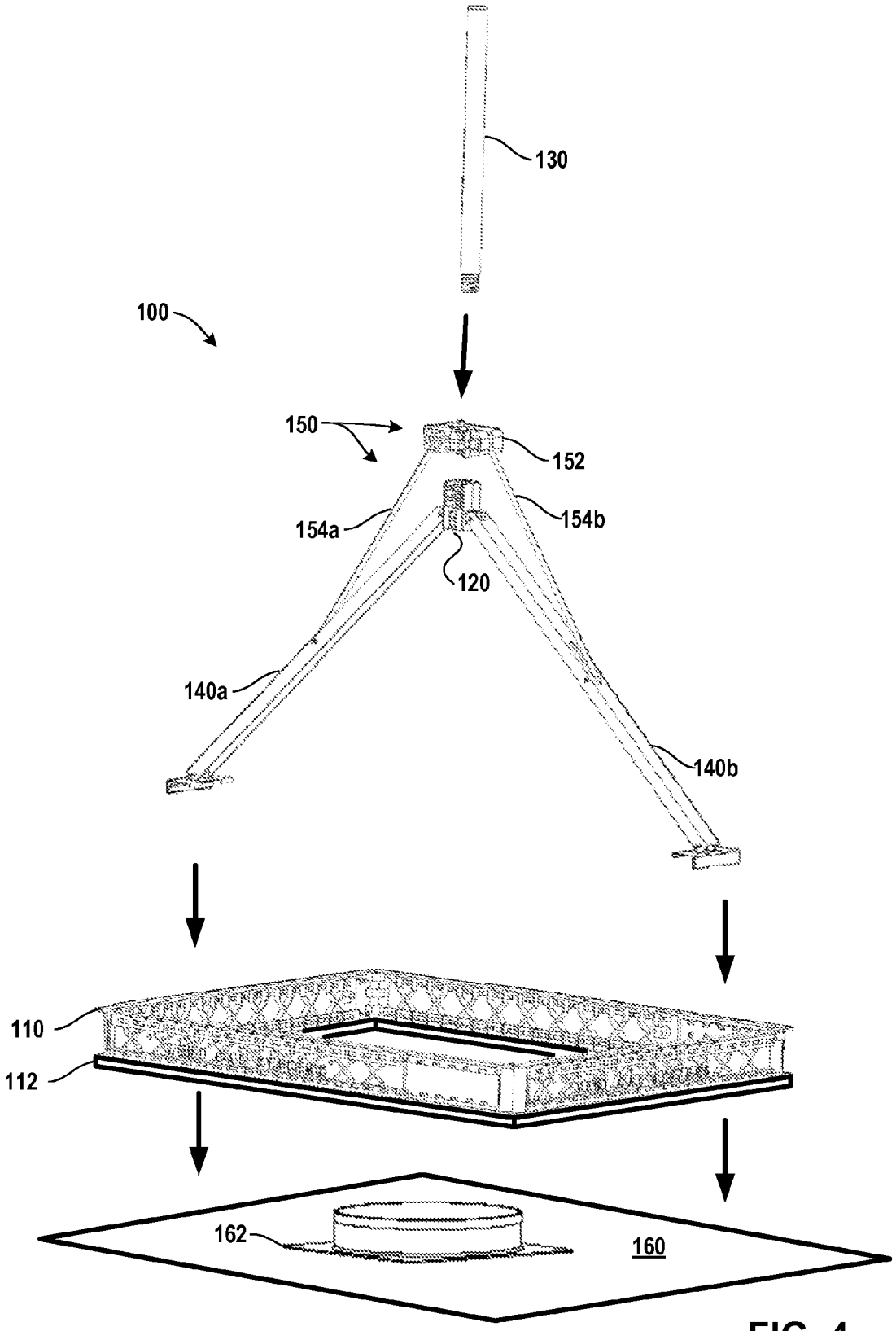
FIG. 4 sets forth a line drawing illustrating an exploded, perspective view of the adjustable air duct sealing system for obstructing airflow through portions of an air duct system according to embodiments of the present invention.

Turning to FIG. 4, FIG. 4 sets forth a line drawing that illustrates an exploded perspective view of the adjustable air duct sealing system (100) for obstructing airflow through portions of an air duct system (102) according to embodiments of the present invention. FIG. 4 illustrates how an operator might assemble an exemplary air duct sealing system (100). The operator may first lay a sheet cover (160) on the floor where the air duct sealing system (100) is to be used. As previously mentioned the sheet cover (160) of FIG. 4 has integrated into the sheet cover (160) an air duct connector (162) to which a flex duct or similar duct may be connected and mounted.

An operator may then place the adjustable frame assembly (110) of FIG. 4 on the sheet cover (160) such that the air duct connector (162) is configured on the inside of the frame assembly (110). When the frame assembly (110) of FIG. 4 is placed over the air duct connector (162), portions of the sheet cover (160) may extend beyond the frame assembly (110) to facility wrapping the sheet cover (160) across the frame assembly (110) and holding it in place as further described below with respect to FIGS. 5A and 5B. One of skill in the art, however, will recognize that extending the sheet cover (160) beyond the perimeter of the frame assembly (110) as in the example of FIG. 4 is for explanation only not limitation. In some embodiments, the perimeter of an exemplary sheet cover may attach to the perimeter of an exemplary frame assembly. Such a perimeter to perimeter connection may be implemented using a hook and loop type fastener, clips, or any other fastener as will occur to those of skill in the art.

In the example of FIG. 4, the exemplary air duct sealing system (100) includes a gasket (112) mounted to the side of the frame assembly (110) directed toward the sheet cover (160). The gasket helps create a seal between the sheet cover and a region around the air vent that is being sealed with the air duct sealing system (100) as the air duct sealing system (100) presses toward the air vent. A gasket is a mechanical seal that fills the space between two mating surfaces. Gaskets allow "less-than-perfect" mating surfaces to seal by filling in irregularities of the mating surfaces. For example, the gasket of may help the air duct sealing system seal against rough surface such as an interior ceiling or wall with a popcorn texture or other rough texture. The gasket may be formed from a variety of materials as will occur to those of skill in the art, including, for example, foam, rubber, nylon, or plastic. When formed from material such as foam, readers will note that there are two types of foam that could be used to create a gasket according to embodiments of the present invention—open-cell foam and closed-cell foam.

In open-cell foam, the cell walls, or surfaces of the bubbles, are broken and air fills all of the spaces in the material. In this manner, open-cell foam creates a permeable barrier that may allow air to flow through it when uncompressed. When compressed, however, the open-cell foam may provide enough of a barrier to serve as a seal. The open-cell nature makes the foam soft or weak, as if it were made of broken balloons or soft toy rubber balls. The insulation value of this foam is related to the insulation value of the calm air inside the matrix of broken cells.

In closed-cell foam, most of the cells or bubbles in the foam are not broken; they resemble inflated balloons or soccer balls, piled together in a compact configuration. This makes the closed-cell foam strong or rigid because the bubbles are strong enough to withstand high-pressure. Although closed-cell foam is rigid, it has varying degrees of hardness, depending on its density. Because the cell walls of closed-cell foam are not generally broken, closed-cell foam provides greater resistance to air leakage than that of open-celled foam.

In the exemplary embodiment of FIG. 4, the actuator pole connector (120), the support arms (140*a* and 140*b*), and stabilizer assembly (150), which is composed of the tension arms (154*a* and 154*b*) and the stabilizing collar (152), are pre-assembled together and are connected to the frame assembly (110) by the support arms (140*a* and 140*b*) after the frame assembly (110) is placed over the air duct connector (162). The manner in which the support arms (140*a* and 140*b*) of FIG. 4 are connected to the exemplary frame assembly (110) is described in more detail with reference to FIGS. 6A and 6B.

After the frame assembly (110) of FIG. 4 is connected to the sheet cover (160) and the support arms (140*a* and 140*b*) are connected to the frame assembly (110), then an operator may insert the actuator pole (130) into the actuator pole connector (120). The actuator pole (130) of FIG. 4 passes through the stabilizing collar (152) as the actuator pole (130) is inserted into the actuator pole connector (120).

Figure 5A:
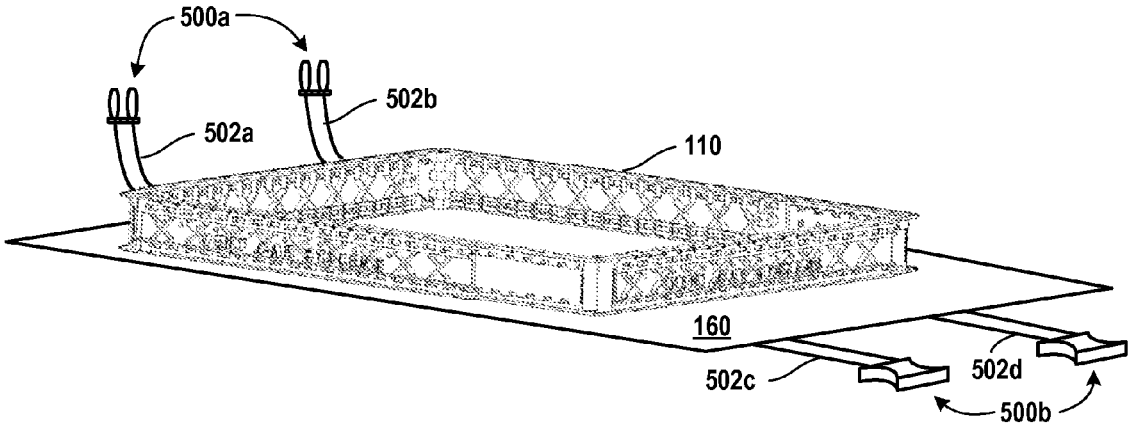
FIG. 5A sets forth a line drawing showing a perspective view of an exemplary frame assembly and exemplary sheet cover useful in an exemplary adjustable air duct sealing system for obstructing airflow through portions of an air duct system according to embodiments of the present invention.
Figure 5B:
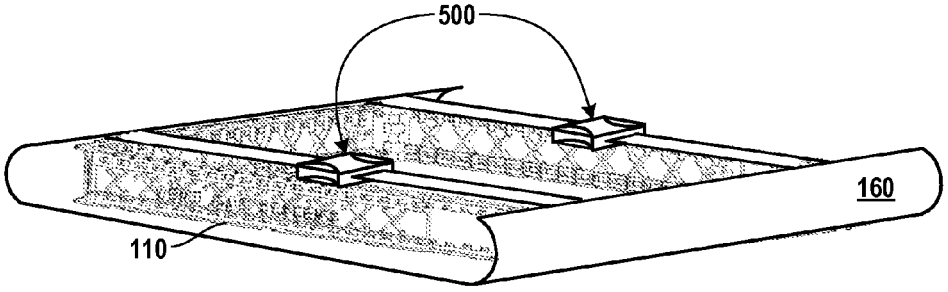
FIG. 5B sets forth a line drawing illustrating a perspective view of an exemplary frame assembly and exemplary sheet cover useful in an exemplary adjustable air duct sealing system for obstructing airflow through portions of an air duct system according to embodiments of the present invention.

For further explanation of how exemplary sheet covers may be configured on and adjustable frame assembly, consider FIGS. 5A and 5B that illustrate line drawings showing a perspective view of an exemplary frame assembly (110) and exemplary sheet cover (160) useful in an adjustable air duct sealing system for obstructing airflow through portions of an air duct system according to embodiments of the present invention. In the example of FIGS. 5A and 5B, the exemplary sheet cover (160) is laid out on a floor or other surface. The frame assembly (110) of FIGS. 5A and 5B is placed upside down on top of the sheet cover (160) taking care to place the frame assembly at approximately the center of the sheet cover (160).

In the example of FIGS. 5A and 5B, the sheet cover (160) includes straps (502*a*, 502*b*, 502*c*, 502*d*). At ends of straps (502*a*, 502*b*, 502*c*, 502*d*), a clip fastener (500*a* and 500*b*) is attached in the example of FIGS. 5A and 5B. To attach the exemplary sheet cover (160) to the exemplary frame assembly (110), an operator merely folds the ends of the sheet cover (160) over the ends of the frame assembly (110) and connect the clip fasteners (500*a* and 500*b*). Although not shown for clarity, the straps (502*a*, 502*b*, 502*c*, 502*d*) are adjustable in a manner as will occur to those of skill of the art using an adjustable loop.

The exemplary manner for connecting the sheet cover (160) of FIGS. 5A and 5B to the frame assembly (110) is illustrated and described for explanation and not for limitation. In other embodiments, other structures and mechanism may be useful in attaching exemplary sheet covers to exemplary frame assemblies. For example, in some embodiments, a hook and loop fastener may be used rather than a clip fastener. In still other embodiments, no straps may be used and the edges of an exemplary sheet cloth may have hooks or other fasteners that connect directly to a corresponding fastener on the other edges of the sheet cover or directly to the frame assembly itself.

Figure 6A:
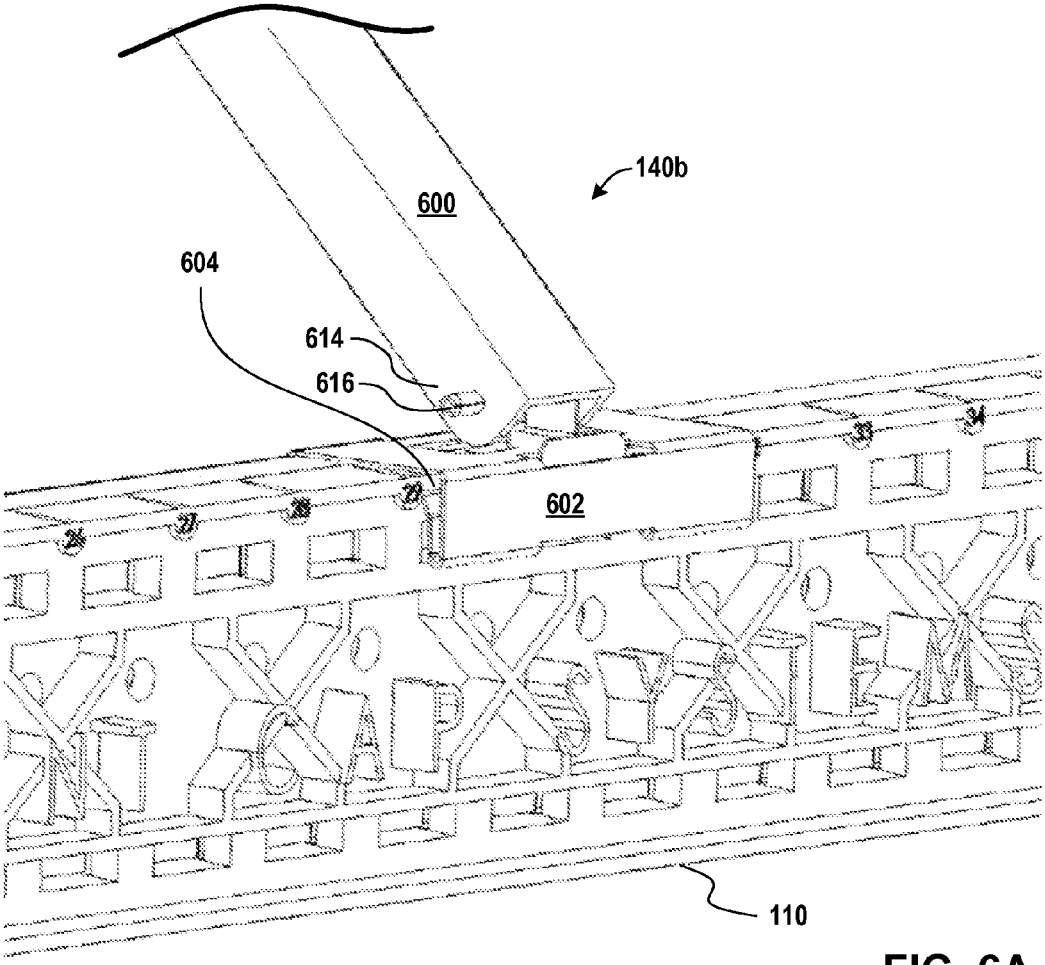
FIG. 6A sets forth a line drawing illustrating a perspective view of an exemplary support arm and exemplary frame assembly useful in an exemplary adjustable air duct sealing system for obstructing airflow through portions of an air duct system according to embodiments of the present invention.
Figure 6B:
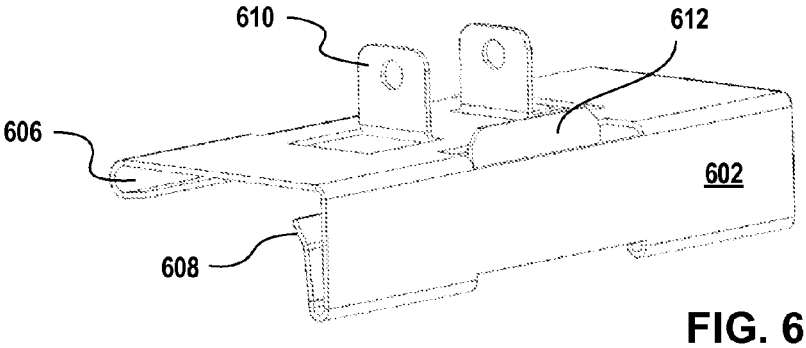
FIG. 6B sets forth a line drawing illustrating a perspective view of an exemplary rail fastener for an exemplary support arm useful in an exemplary adjustable air duct sealing system for obstructing airflow through portions of an air duct system according to embodiments of the present invention.

For further explanation of the connection between exemplary support arms and exemplary frame assemblies useful according to embodiments of the present invention, consider FIGS. 6A and 6B that illustrate a perspective view of the exemplary support arm (140*b*) of FIG. 1 and its connection to the exemplary frame assembly (110) of FIG. 1. In the example of FIG. 5A, the support arm (140*b*) includes a support extension (600) and a support fastener. The support fastener of FIGS. 5A and 5B is implemented as a rail fastener (602). The support extension (600) and the rail fastener (602) connect together with an integrated hinge that provides a range of movement relative to one another. The support extension (600) has a knuckle (614) that corresponds with the knuckle (610) of the rail fastener (602). In the example of FIGS. 6A and 6B, a hinge pin (616) holds both of the knuckles (610, 614) in place.

The rail fastener (602) of FIGS. 5A and 5B attaches to a rail frame assembly (110) by snapping in place onto the exemplary frame rail of the rail assembly. In the example of FIGS. 5A and 5B, the rail fastener (602) snaps into place by engaging the rear catch (606) with a corresponding feature on the frame rail of the frame assembly (110). This corresponding feature may be implemented as a horizontal lip that traverses the entire length of a frame rail.

After engaging the rear catch (606) with the frame rail of the frame assembly (110), the operator may then press the rail fastener (602) down on the frame rail of the frame assembly (110) until the front catch (608) engages a corresponding feature (604) on the front of the rail frame assembly (110). The feature (604) that engages with the front catch (608) in the example of FIGS. 6A and 6B is implemented as a lip traverses the length of the frame rail of the frame assembly (110).

To release the rail fastener (602) from the frame rail of the frame assembly (110), the operator merely presses the release tab (612)—specifically, the operator moves the release tab (612) forward. In so doing, the forward catch (608) disengages from the lip feature (604), and the rail fastener (602) may be lifted from the frame rail. At that point, the operator may disengage the rear catch (606) from the feature holding it in place on the frame assembly (110).

The connection between the support arm (140*b*) and the frame assembly (110) in the example of FIGS. 6A and 6B is for explanation only and not for limitation. Other embodiments may implement the connection between exemplary support arms and exemplary frame assemblies differently. For example, in other embodiments of the present invention, an exemplary support arm and an exemplary frame assembly may be connected using a strap that wraps around or through the exemplary frame assembly and secures the exemplary support arm to the exemplary frame assembly. Of course those skilled in the art will understand that other mechanisms or structures useful in adjustable air duct sealing system for obstructing airflow through portions of an air duct system according to embodiments of the present invention may also be implemented.

Figure 7:
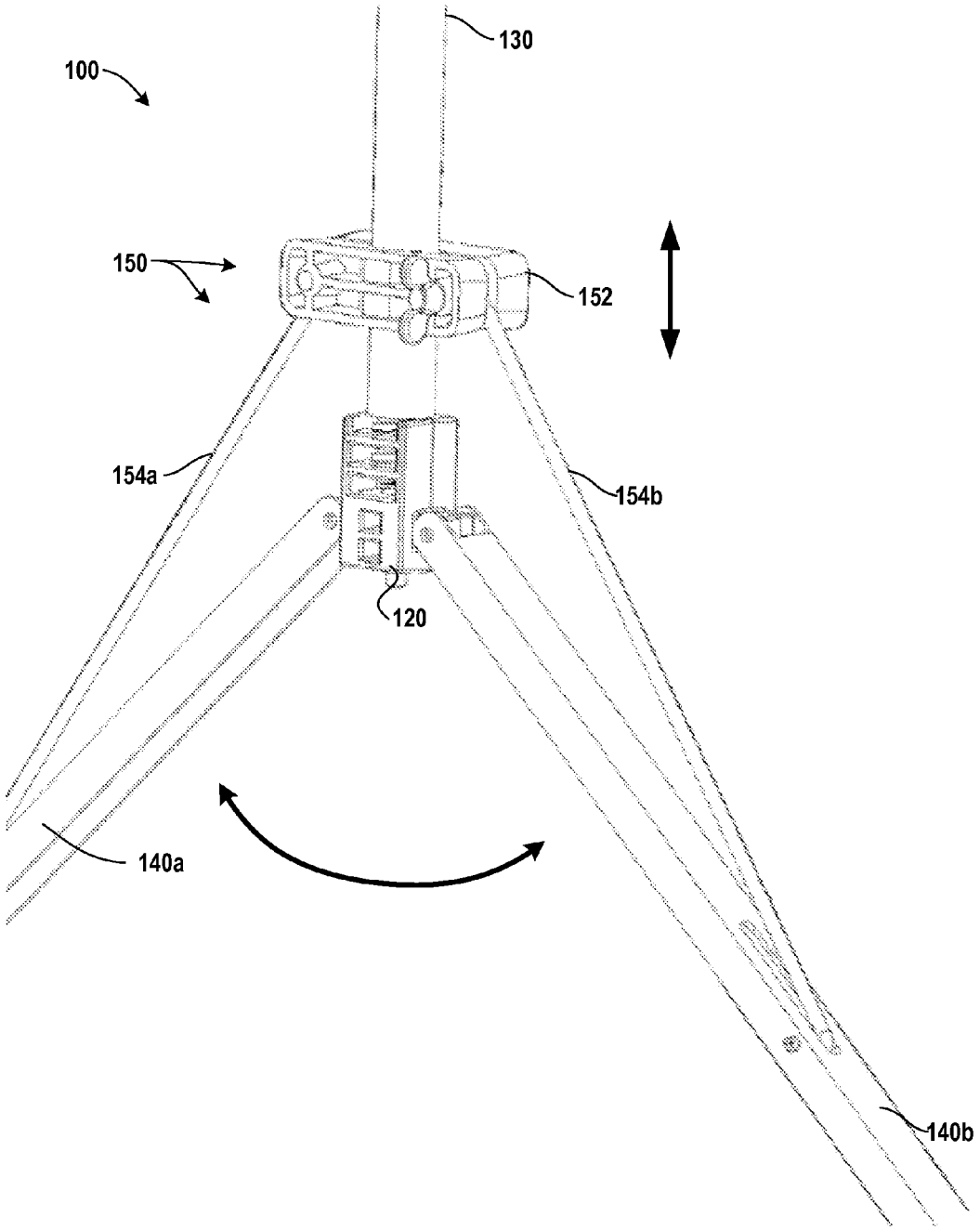
FIG. 7 sets forth a line drawing illustrating in perspective view of the pattern of movement of various components in an exemplary adjustable air duct sealing system for obstructing airflow through portions of an air duct system according to embodiments of the present invention.

FIG. 7 sets forth a line drawing illustrating in perspective view of the pattern of movement of various components in the exemplary adjustable air duct sealing system (100) of FIG. 1 for obstructing airflow through portions of an air duct system according to embodiments of the present invention. Basically, the movements of the various components relative to one another stem from the operator changing the perimeter of the adjustable frame assembly (110 on FIGS. 1 and 4). As the width of the frame assembly increases, the support arms (140*a* and 140*b*), and consequentially tension arms (154*a* and 154*b*), must swing further away from each other to be able to connect to the frame assembly (110 on FIGS. 1 and 4). As the width of the frame assembly decreases, the support arms (140*a* and 140*b*), and consequentially the tension arms (154*a* and 154*b*), must swing closer together to be able to connect to the frame assembly (110 on FIGS. 1 and 4).

Consider that the actuator pole connector (120) is the reference point for determining the movement of the other components in the air duct sealing system (100). As the support arms (140*a* and 140*b*), and consequentially tension arms (154*a* and 154*b*), swing away from each other, the stabilizing collar (152) of the stabilizer assembly (150) slides along the actuator pole (130) and is pushed away from the actuator pole connector (120). Similarly, as the support arms (140*a* and 140*b*), and consequentially tension arms (154*a* and 154*b*), swing toward each other, the stabilizing collar (152) of the stabilizer assembly (150) slides along the actuator pole (130) and is pulled toward the actuator pole connector (120).

For further explanation of the exemplary stabilizer assembly (150) of the adjustable air duct sealing system (100) for obstructing airflow through portions of an air duct system as described with reference to FIG. 1, consider FIG. 8 that sets forth a line drawing of an exploded, perspective view of the stabilizer assembly (150) of FIG. 1. As previously mentioned, the stabilizer assembly (150) shown in FIG. 8 includes a tension arm (154*b*) and a stabilizing collar (152).

Figure 8:
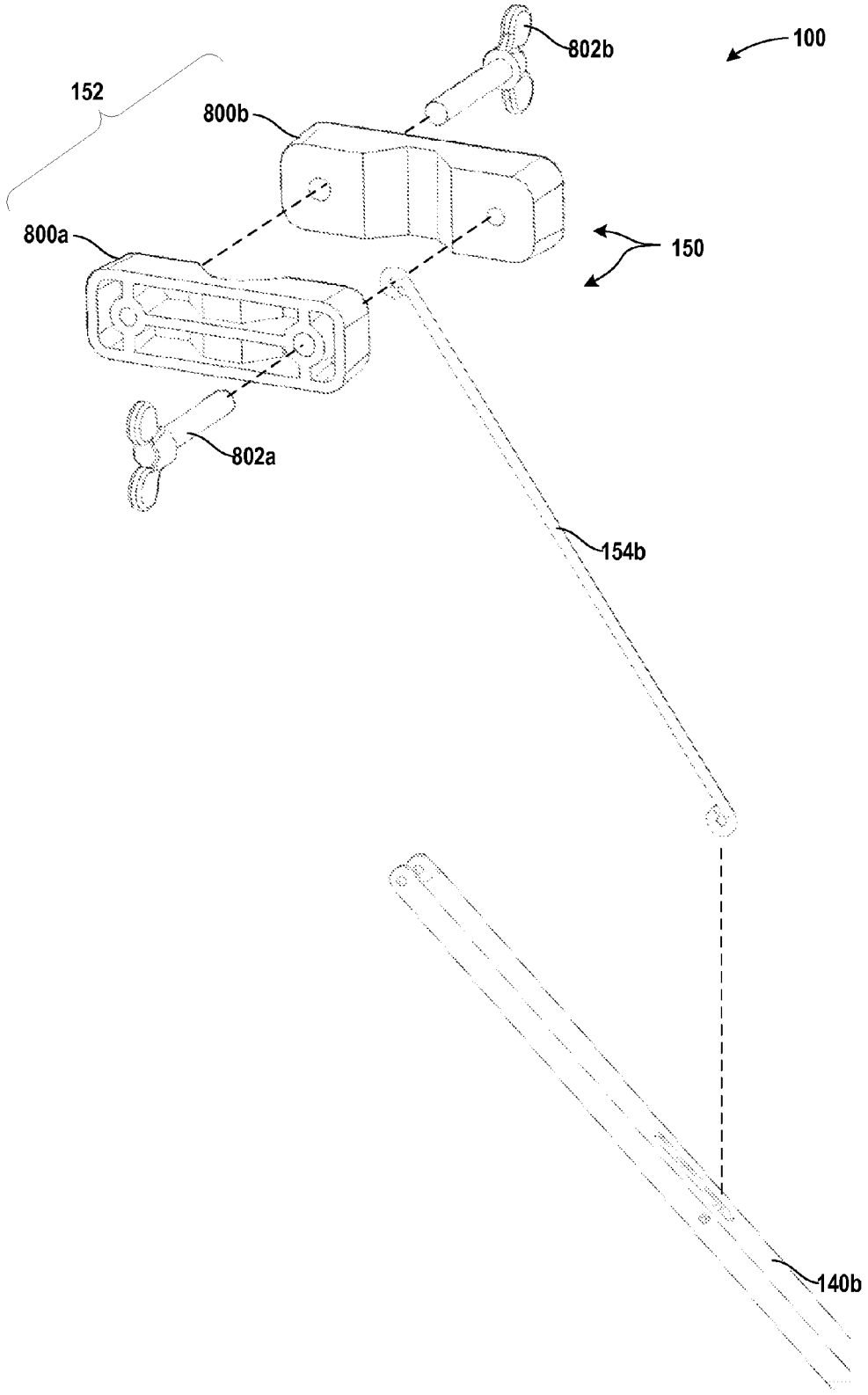
FIG. 8 sets forth a line drawing illustrating an exploded, perspective view of an exemplary stabilizer assembly of an exemplary adjustable air duct sealing system for obstructing airflow through portions of an air duct system according to embodiments of the present invention.

The tension arm (154*b*) of FIG. 8 is formed from a thick wire configured to be substantially straight, but with loops formed at the ends. These loops serve as hinge knuckles when the tension arm (154*b*) is connected to the support arm (140*b*) and the stabilizing collar (152) as illustrated in the example of FIG. 8.

In the example of FIG. 8, the stabilizing collar (152) is formed from two base plates (800*a* and 800*b*). The two base plates (800*a* and 800*b*) of FIG. 8 are connected together with wing screws (802*a* and 802*b*). To connect the tension arm (154*b*) to the stabilizing collar (152), the wing screw (802*a*) passes through the loop formed at the end of the tension arm (154*b*).

The exemplary adjustable air duct sealing system (100) for obstructing airflow through portions of an air duct system as described with reference to FIGS. 1-8 assists to seal off portions of an air duct system. There are other components and devices useful in sealing off air vents such as, for example, vent covers described in the following applications: Non-Provisional application Ser. No. 12/757,397 entitled "Air Vent Cover For Use In Testing Air Leakage Of An Air Duct System" and filed on Apr. 9, 2010; Provisional Application No. 61/447,014 entitled "Installation And Removal Tool For Use With An Air Vent Cover For Sealing An Air Vent" and filed on Feb. 26, 2011; Non-Provisional application Ser. No. 13/108,957 entitled "Air Duct Blocking Device For Obstructing Airflow Through Portions Of An Air Duct System" and filed on May 16, 2011; and Non-Provisional application Ser. No. 13/754,865 entitled "Air Duct Sealing System For Obstructing or Directing Airflow Through Portions Of An Air Duct System" and filed on Jan. 30, 2013, all of which are incorporated herein by reference in its entirety.

Figure 9A:
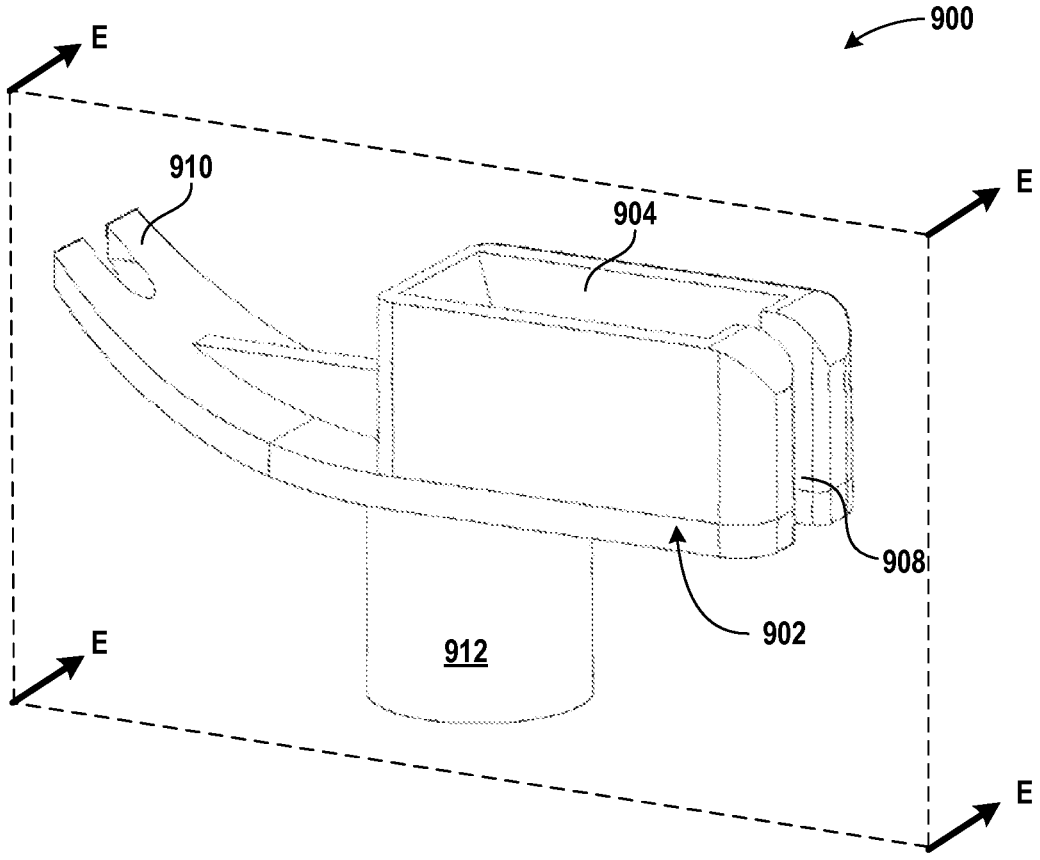
FIG. 9A sets forth a line drawing illustrating a perspective view of an exemplary remote actuator tool for installing and removing an air vent cover in an air duct sealing system according to embodiments of the present invention.
Figure 9B:
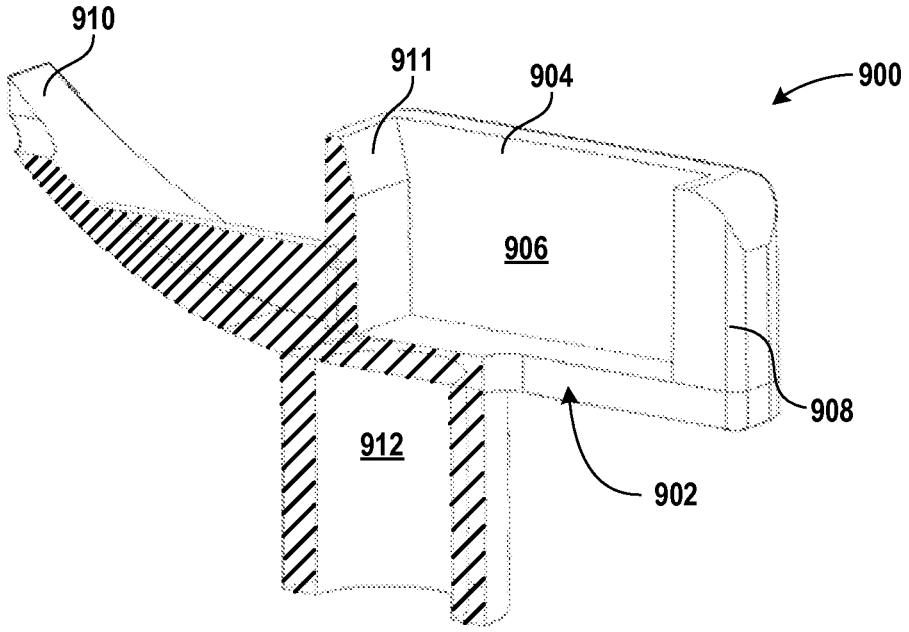
FIG. 9B sets forth a line drawing illustrating a perspective view of cross-section E-E-E-E of the exemplary remote actuator tool of FIG. 9A for installing and removing an air vent cover in an air duct sealing system according to embodiments of the present invention.

Often such air vent covers must be installed at remote distances on a ceiling and are unreachable by an operator on foot. Accordingly, embodiments of the present invention disclose remote actuator tool for installing and removing an air vent cover in an air duct sealing system. FIG. 9A sets forth a line drawing illustrating a perspective view of an exemplary remote actuator tool (900) for installing and removing an air vent cover in an air duct sealing system according to embodiments of the present invention. FIG. 9B sets forth a line drawing illustrating a perspective view of cross-section E-E-E-E of the exemplary remote actuator tool (900) of FIG. 9A for installing and removing an air vent cover in an air duct sealing system according to embodiments of the present invention.

The exemplary remote actuator tool (900) of FIGS. 9A and 9B is comprised of a hollowed casing (902). The hollowed casing (902) of FIGS. 9A and 9B forms the body of the remote actuator tool (900) illustrated in FIGS. 9A and 9B. The hollowed casing (902) of FIGS. 9A and 9B includes an opening (904) on one side of the casing (902) and form a casing interior (906) configured to mate with an adjustable fastener of the air vent cover when an actuator button of the adjustable fastener is depressed. To enable an operator to depress an engagement button of an adjustable fastener at remote distances, the casing interior (906) includes a beveled edge (911). The beveled edge (911) of FIG. 9B forces an engagement button on an adjustable fastener to depress as the adjustable fastener enters the opening (904) into the hollowed chamber created by the casing (902).

In the example of FIGS. 9A and 9B, the hallowed casing (902) is substantially in the shape of a rectangular prism. Readers will note that this shape is for explanation only and not for limitation. Rather, one of skill in the art will recognize that the casing may take on a variety of shapes and the shape may be influenced by the shape of the adjustable fastener on the air vent cover that is to interface with the interior of the casing of an exemplary remote actuator tool according to embodiments of the present invention.

The air vent covers that utilize an adjustable fastener may have a cord that slides through the adjustable fastener, which is typically integrated into the air vent cover. The cord typically has a hook on one end that attaches to an air vent, register boot or the like. To secure the air vent cover in its place, the air vent cover slides along the cord, which passes through the adjustable fastener. When the air vent cover reaches the desired point, the adjustable fastener engages with the cord to hold the air vent cover in place.

To allow the remote actuator tool (900) of FIGS. 9A and 9B to be used to remotely place an air vent cover over an air vent located on the ceiling, the remote actuator tool (900) must provide a way for the engagement button on the adjustable fastener to be depressed and allow the air vent cover to slide along the cord. Merely placing the air vent cover onto the tool (900) by inserting the adjustable fastener of the air vent cover into the opening (904) to mate with the casing interior (906) will operate to keep the engagement button depressed while the operator manipulates the air vent cover at a distance with the remote actuator tool (900).

To prevent the remote actuator tool (900) from interfering with the cord of the air vent cover, thereby inhibiting the ability of the air vent cover to slide along the cord, the casing (902) of FIGS. 9A and 9B includes a slot (908) that extends along a side of the casing (902) adjacent the opening (904) to an opposite end of the casing (902) relative to the opening (904). This slot (908) in the example of FIGS. 9A and 9B allows a cord to pass through the remote actuator tool (900) with minimal interference.

In the example of FIGS. 9A and 9B, the remote actuator tool (900) includes a pivot claw (910) that connects to the casing (902) at the opposite end of the casing (902) relative to the opening (904) and curls toward the opening (904). The pivot claw (910) of FIGS. 9A and 9B provides stability when attaching or removing the air vent cover using the remote actuator tool (900) and provides a fulcrum for disengaging the remote actuator tool (900) from the adjustable fastener of the air vent cover after the air vent cover is set in place.

Figure 10A:
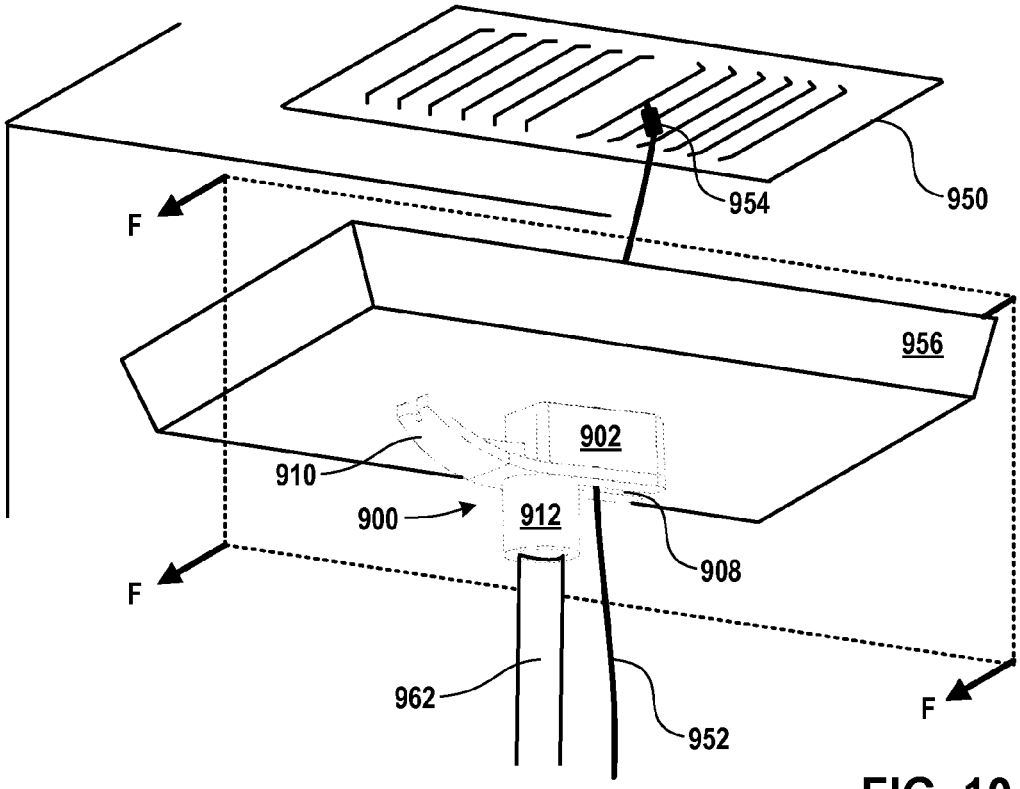
FIG. 10A sets forth a line drawing of a perspective view of an exemplary remote actuator tool for installing and removing an air vent cover in an air duct sealing system according to embodiments of the present invention.
Figure 10B:
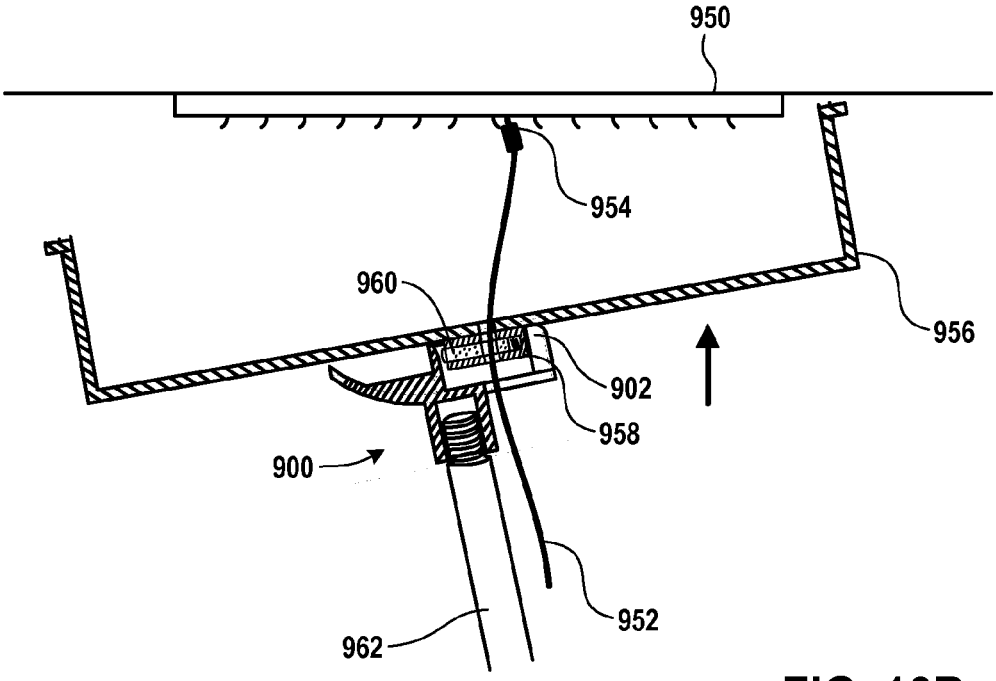
FIG. 10B sets forth a line drawing of a orthogonal view of cross section F-F-F-F of an exemplary remote actuator tool of FIG. 10A for installing and removing an air vent cover in an air duct sealing system according to embodiments of the present invention.
Figure 10C:
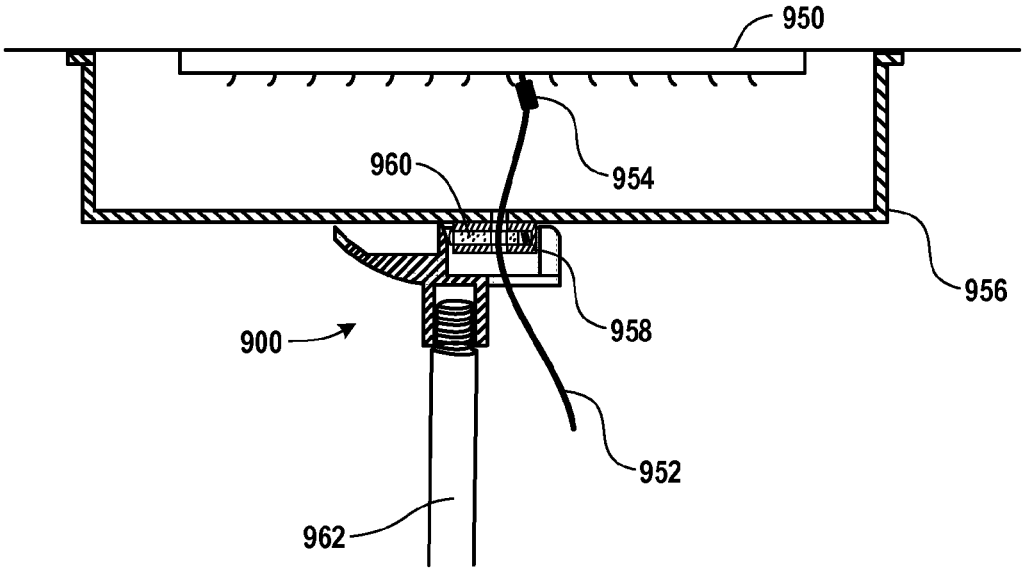
FIG. 10C sets forth a line drawing of a orthogonal view of cross section F-F-F-F of an exemplary remote actuator tool of FIG. 10A for installing and removing an air vent cover in an air duct sealing system according to embodiments of the present invention.
Figure 10D:
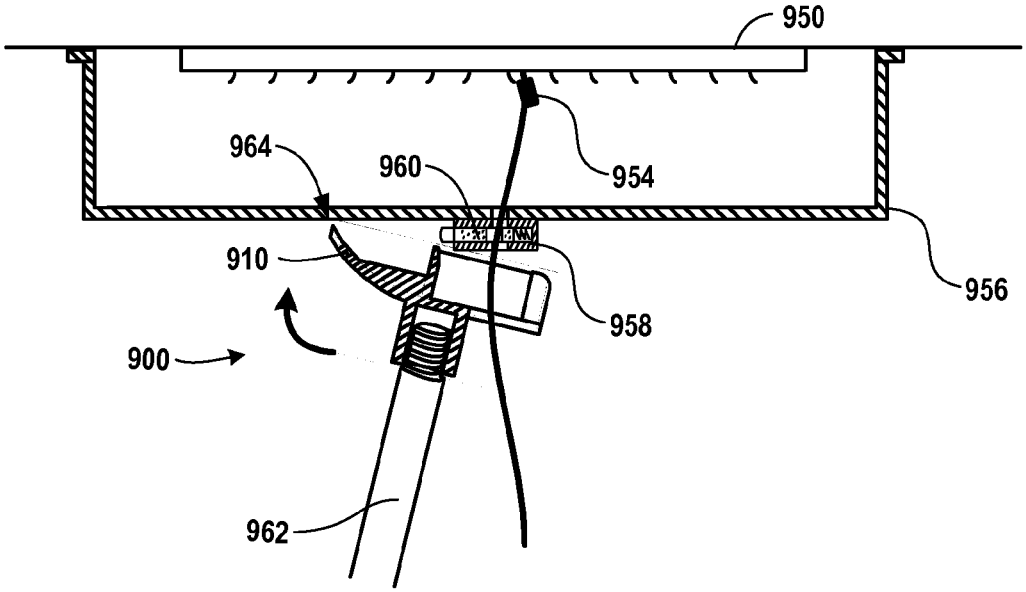
FIG. 10D sets forth a line drawing of a orthogonal view of cross section F-F-F-F of an exemplary remote actuator tool of FIG. 10A for installing and removing an air vent cover in an air duct sealing system according to embodiments of the present invention.

For further explanation of how an exemplary remote actuator tool is used to install an air vent cover, consider FIGS. 10A through 10D. FIG. 10A sets forth a line drawing of a perspective view of an exemplary remote actuator tool (900) for installing and removing an air vent cover (956) in an air duct sealing system according to embodiments of the present invention. FIGS. 10B through 10D set forth line drawings depicting the cross-section F-F-F-F from FIG. 10A showing the exemplary remote actuator tool (900) of FIG. 10 in various phases of installing an air vent cover (956) over an air vent (950).

The remote actuator tool (900) of FIGS. 10A through 10D is the same remote actuator tool (900) described with reference to FIG. 9. In the example of FIGS. 10A through 10D, an operator has inserted a hook (954) in the air vent (950). The hook (954) of FIGS. 10A through 10D is connected to a cord that passes through an adjustable fastener (shown at 958 on FIGS. 10B-D). The cord passes freely through the adjustable fastener (958 on FIGS. 10B-D) because the engagement button (960) remains depressed while inside the hollow casing (902). Because the engagement button of the adjustable fastener (958) of the FIGS. 10B-D is spring loaded, the engagement button would not remained depressed without being held in place by the remote actuator tool (900). The cord (952) of the air vent cover (956) passes through the slot (908) in the casing (902) of the remote actuator tool (900) so as not to interfere with the ability to of the air vent cover (956) to slide up and down the cord (952).

FIG. 10B illustrates an operator raising the air vent cover (956) toward the air vent (950) using the remote actuator tool (900) on the end of an actuator pole (962). FIG. 10C illustrates an operator setting the air vent cover (956) over the air vent (950) using the remote actuator tool (900) on the end of an actuator pole (962). FIG. 10D illustrates an operator pivoting the remote actuator tool (900) with the actuator pole (962) using the pivot claw (910) to create a fulcrum (964) where the pivot claw touches the air vent cover. In such a manner, the remote actuator tool (900) rotates around the ad hoc fulcrum at the tip of the pivot claw (910) and rotates off of the adjustable fastener (958) of the air vent cover (956).

While certain exemplary embodiments have been described in details and shown in the accompanying drawings, it is to be understood that such embodiments are merely illustrative of and not devised without departing from the basic scope thereof, which is determined by the claims that follow.

What we claim is:

1. An adjustable air duct sealing system for obstructing airflow through portions of an air duct system, the removable air duct sealing system comprising:

an adjustable frame assembly configured to allow changes to a perimeter of the adjustable frame assembly;

an actuator pole connector configured to attach the adjustable air duct sealing system to an actuator pole;

two or more support arms, each support arm connecting the actuator pole connector to the adjustable frame assembly, each support arm moveably connected to the actuator pole connector to allow the support arms to adjust to changes in the perimeter of the adjustable frame assembly; and a sheet cover configured across the adjustable frame assembly to obstruct airflow through at least a portion of the adjustable frame assembly, wherein the sheet cover comprises an air duct connector capable of directing airflow through the adjustable frame assembly at the air duct connector while obstructing airflow through other portions of the adjustable frame assembly.

2. The adjustable air duct sealing system of claim 1 wherein the adjustable frame assembly is substantially rectangular in shape.

3. The adjustable air duct sealing system of claim 2 wherein the adjustable frame assembly comprises a plurality of frame rails.

4. The adjustable air duct sealing system of claim 3 wherein each of at least two opposite sides of the adjustable frame assembly comprises two of the plurality of frame rails configured to interlock with one another and slide parallel to one another.

5. The adjustable air duct sealing system of claim 4 further comprising a lock detent for securing the two frame rails in place relative to one another.

6. The adjustable air duct sealing system of claim 5 wherein the lock detent secures the two frame rails in place relative to one another at predetermined positions.

7. The adjustable air duct sealing system of claim 3 wherein each corner of the adjustable frame assembly is formed from two of the plurality of frame rails connected together with a hinge.

8. The adjustable air duct sealing system of claim 7 wherein the two frame rails forming each corner comprise an overextension detent configured to prevent the two frame rails from opening relative to one another substantially more than ninety degrees.

9. The adjustable air duct sealing system of claim 1 wherein the adjustable frame assembly further comprises a gasket along the perimeter of the frame assembly to facilitate sealing the air duct sealing system with an opening in the air duct system.

10. The adjustable air duct sealing system of claim 1 wherein the sheet cover is configured across the frame assembly on a side opposite the actuator pole connector and is configured to wrap around the frame assembly to be secured on the same side of the frame assembly as the actuator pole connector.

11. The adjustable air duct sealing system of claim 1 wherein each of the two or more support arms is configured with a rail fastener to connect that support arm to the frame assembly.

12. The adjustable air duct sealing system of claim 11 wherein the rail fastener snaps onto the frame assembly and comprises a catch to release the rail fastener from the frame assembly.

13. The adjustable air duct sealing system of claim 1 wherein each support arm is moveably connected to the actuator pole connector using a hinge.

14. The adjustable air duct sealing system of claim 1 further comprising a stabilizer assembly, wherein the stabilizer assembly comprises a stabilizing collar and two or more tension arms, each tension arm connected to one of the two or more supporting arms, each tension arm moveably connected to the stabilizing collar to allow the tension arm to adjust to changes in position of the supporting arm to which that tension arm connects.

15. The adjustable air duct sealing system of claim 14 wherein the stabilizing collar forms a hollowed central region to allow the actuator pole to pass through the stabilizing collar when the actuator pole is configured in the actuator pole connector and configured to move coaxially along the actuator pole as the two or more tension arms change position relative to the stabilizing collar.

* * * * *